US009056484B2

(12) United States Patent
Ito et al.

(10) Patent No.: US 9,056,484 B2
(45) **Date of Patent: *Jun. 16, 2015**

(54) LIQUID EJECTING APPARATUS

(71) Applicant: Seiko Epson Corporation, Tokyo (JP)

(72) Inventors: Koji Ito, Shiojiri (JP); Masato Murayama, Matsumoto (JP); Ryoji Fujimori, Matsumoto (JP); Koji Harada, Shiojiri (JP); Tsuyoshi Hayashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/295,954

(22) Filed: Jun. 4, 2014

(65) Prior Publication Data

US 2014/0285589 A1 Sep. 25, 2014

Related U.S. Application Data

(63) Continuation of application No. 13/850,397, filed on Mar. 26, 2013, now Pat. No. 8,764,176.

(30) Foreign Application Priority Data

| | | |
|---|---|---|
| Apr. 26, 2012 | (JP) | 2012-100920 |
| Apr. 27, 2012 | (JP) | 2012-102661 |
| Feb. 13, 2013 | (JP) | 2013-025915 |

(51) Int. Cl.
*B41J 2/175* (2006.01)
*B41J 2/18* (2006.01)

(52) U.S. Cl.
CPC ..... *B41J 2/17596* (2013.01); *B41J 2/18* (2013.01); *B41J 2/175* (2013.01)

(58) Field of Classification Search
USPC ..... 347/7, 84, 85, 86, 89
See application file for complete search history.

(56) References Cited

U.S. PATENT DOCUMENTS

| | | | | |
|---|---|---|---|---|
| 5,561,448 | A | 10/1996 | Kaneko et al. | |
| 6,443,560 | B1 | 9/2002 | Okano et al. | |
| 7,597,434 | B2 * | 10/2009 | Nitta et al. | 347/89 |

(Continued)

FOREIGN PATENT DOCUMENTS

| | | |
|---|---|---|
| JP | 2005-305764 | 11/2005 |
| JP | 2007-313884 | 12/2007 |

(Continued)

OTHER PUBLICATIONS

U.S. Appl. No. 13/850,397, filed Feb. 24, 2014, Notice of Allowance.

*Primary Examiner* — Anh T. N. Vo
(74) *Attorney, Agent, or Firm* — Workman Nydegger

(57) ABSTRACT

A liquid ejecting apparatus includes a liquid ejecting head, an ink supply tube that supplies ink to the liquid ejecting head, a pressure control valve that opens as a result of depressurization on the liquid ejecting head side, a check valve provided upstream from the pressure control valve, an ink circulation tube that is connected at both ends to the ink supply tube between the pressure control valve and the check valve, and a tube pump provided in the ink circulation tube; in this configuration, by providing at least one of an ink return tube and a liquid reservoir portion that is capable of holding liquid in a liquid flow channel in a pressurized state, a rise in pressure within a circulating flow channel caused by pump operations can be suppressed.

7 Claims, 11 Drawing Sheets

(56) References Cited

U.S. PATENT DOCUMENTS

| | | | | |
|---|---|---|---|---|
| 7,850,290 | B2 | 12/2010 | Nitta et al. | |
| 7,901,063 | B2 | 3/2011 | Wouters et al. | |
| 8,128,217 | B2 * | 3/2012 | Adams et al. | 347/104 |
| 8,308,252 | B2 * | 11/2012 | Shimoda | 347/6 |
| 8,764,176 | B2 * | 7/2014 | Ito et al. | 347/89 |
| 8,794,747 | B2 * | 8/2014 | Enomoto et al. | 347/85 |
| 2007/0252860 | A1 | 11/2007 | Nitta et al. | |
| 2013/0021396 | A1 | 1/2013 | Hirano | |

FOREIGN PATENT DOCUMENTS

| | | |
|---|---|---|
| JP | 2009-279932 | 12/2009 |
| JP | 2011-116102 | 6/2011 |
| JP | 2011-255643 | 12/2011 |

* cited by examiner

| | WITHOUT RETURN FLOW CHANNEL | WITH RETURN FLOW CHANNEL |
|---|---|---|
| MAXIMUM PRESSURE ON EXIT SIDE OF TUBE PUMP | 100% | 44% |
| MAXIMUM NEGATIVE PRESSURE ON INK CARTRIDGE SIDE | 100% | 36% |
| INK INFLOW AMOUNT FROM INK CARTRIDGE | 100% | 22.5% |

LIQUID EJECTING APPARATUS

The present application claims priority to U.S. patent application Ser. No. 13/850,397 filed on Mar. 26, 2013, which claims priority to Japanese Patent Application Nos. 2012-100920, filed Apr. 26, 2012, 2012-102661, filed Apr. 27, 2012 and 2013-025915, filed Feb. 13, 2013, which applications are expressly incorporated by reference herein.

BACKGROUND

1. Technical Field

The present invention relates to liquid ejecting apparatuses, and particularly relates to a configuration for a liquid flow channel that supplies a liquid to a liquid ejecting head.

2. Related Art

Generally, ink jet printers have been widely known for some time as one type of liquid ejecting apparatus that ejects a liquid onto a medium. Such printers carry out printing by ejecting ink (a liquid) supplied from an ink cartridge (a liquid supply source) from an ejecting nozzle formed in a liquid ejecting head onto a medium (for example, paper). Recently, pigment inks are being used in such printers in order to realize high-image quality printing.

Pigment inks have a problem in that the pigment particles sink in the ink carrier as time passes, resulting in imbalances in the concentration of the pigment ink, which in turn leads to changes in the tint. It is particularly easy for pigment particles to sink within a liquid flow channel from the ink cartridge to the liquid ejecting head in the case where the liquid flow channel is long. Accordingly, even if agitated ink is supplied to the liquid flow channel from the ink cartridge, it is difficult to suppress changes in the tint of the pigment ink unless imbalances in the concentration of the pigment ink are suppressed in the liquid flow channel between the ink cartridge and the liquid ejecting head.

Accordingly, JP-A-2011-255643, for example, proposes a technique for agitating ink in a liquid flow channel. This technique is a technique for instigating ink flow within a liquid flow channel and agitating the ink by using a tube pump in which rollers rotate while squeezing a flexible tube in order to produce pressure fluctuations within a circulating flow channel that configures part of the liquid flow channel.

Incidentally, in printers, a check valve is normally provided between the liquid supply source and the circulating flow channel to ensure that the ink does not flow in reverse from the liquid flow channel toward the liquid supply source. Accordingly, in the case where ink is caused to flow through a circulating flow channel using pressure fluctuations that are repeatedly produced by a tube pump as disclosed in JP-A-2011-255643, the ink will flow into the circulating flow channel from the liquid supply source side via the check valve when the pressure fluctuations cause a drop in the pressure within the circulating flow channel near the check valve. A phenomenon will then occur in which the ink that has flowed into the circulating flow channel will not return toward the liquid supply source due to the effect of the check valve, even after the drop in the pressure within the circulating flow channel near the check valve has been eliminated.

Accordingly, if the tube pump is driven for a long period of time, the ink will repeatedly flow into the circulating flow channel from a liquid holding member as a result of the repeated drops in the pressure, leading to a gradual increase in the amount of ink within the circulating flow channel; this in turn will cause the pressure of the ink within the circulating flow channel to rise. As a result, in the case where the circulating flow channel (liquid flow channel) is formed by connecting a plurality of tubes, the connections between the tubes can become disengaged, the tubes can rupture, or the like.

Note that the situation is not limited to ink jet printers, and has generally been common in any liquid ejecting apparatus that supplies a liquid to an ejection mechanism from a liquid supply source via a liquid flow channel in which a check valve is provided and that ejects the stated liquid through the ejection mechanism.

SUMMARY

It is an advantage of some aspects of the invention to provide a liquid ejecting apparatus capable of suppressing a rise in pressure within a circulating flow channel caused by pump operations.

A liquid ejecting apparatus according to an aspect of the invention includes: a liquid ejecting head that ejects a liquid; a first liquid flow channel that supplies the liquid from an upstream side corresponding to a liquid supply source side to the liquid ejecting head that is located on a downstream side; a pressure control valve that is provided in the first liquid flow channel and that opens as a result of a drop in pressure on the liquid ejecting head side; a check valve that is provided in the first liquid flow channel closer to the liquid supply source than the pressure control valve and that prevents backflow from the pressure control valve side toward the liquid supply source side; a second liquid flow channel, whose one end is connected to a connection portion (C2) on the pressure control valve side and whose other end is connected to a connection portion (C1) on the check valve side between the pressure control valve and the check valve in the first liquid flow channel, that with the first liquid flow channel configures a circulating flow channel in which the liquid circulates; a circulating pump that is provided in the second liquid flow channel and that causes the liquid to flow in one direction in the circulating flow channel; and a third liquid flow channel whose one end is connected to the circulating flow channel and whose other end is connected to an area of the first liquid flow channel that is closer to the liquid supply source side than the check valve.

According to this configuration, even if liquid flows into the circulating flow channel from the upstream side, which corresponds to the liquid supply source side, via the check valve when the circulating pump operates, the liquid that flows in at that time also includes liquid that is returned to the upstream side of the check valve from the circulating flow channel by the third liquid flow channel. Accordingly, an increase in the liquid within the circulating flow channel is suppressed, and a rise in the pressure of the liquid within the circulating flow channel can be suppressed, more than in the case where the third liquid flow channel is not provided.

According to another aspect of the invention, in the liquid ejecting apparatus, it is preferable that the one end of the third liquid flow channel be connected between the circulating pump provided in the second liquid flow channel and the connection portion (C1) on the check valve side where the other end of the second liquid flow channel is connected.

According to this configuration, the liquid that is pressurized by the circulating pump and that flows in the one direction in the second liquid flow channel can be returned to the upstream side, which corresponds to the liquid supply source side, with certainty via the third liquid flow channel, and thus a rise in the pressure of the liquid within the circulating flow channel can be suppressed with a high rate of success.

According to another aspect of the invention, it is preferable that the liquid ejecting apparatus further include: a second check valve that, assuming the check valve serves as a first check valve, is provided in the first liquid flow channel between an area where the other end of the third liquid flow channel is connected and the liquid supply source; and a fourth liquid flow channel whose one end is connected to the second liquid flow channel and whose other end is connected to an area of the first liquid flow channel that is between the second check valve and the liquid supply source side.

According to this configuration, even if the liquid that flows into the circulating flow channel from the liquid supply source side increases, the liquid that has flowed in is liquid that is returned to the liquid supply source side from the circulating flow channel side by the fourth liquid flow channel in addition to the third liquid flow channel, and thus an increase in the liquid within the circulating flow channel can be suppressed.

According to another aspect of the invention, in the liquid ejecting apparatus, it is preferable that a liquid reservoir portion that temporarily holds the liquid in a pressurized state be provided in a flow channel area of at least one of the first liquid flow channel and the second liquid flow channel between the check valve and the pressure control valve.

According to this configuration, even if the liquid that flows into the circulating flow channel from the liquid supply source side via the check valve increases, the increased liquid is temporarily held in the liquid reservoir portion, and thus fluctuations in the pressure of the liquid that pulsates within the circulating flow channel can be suppressed.

In addition, a liquid ejecting apparatus according to another aspect of the invention includes: a liquid ejecting head that ejects a liquid; a first liquid flow channel that supplies the liquid from an upstream side corresponding to a liquid supply source side to the liquid ejecting head that is located on a downstream side; a pressure control valve that is provided in the first liquid flow channel and that opens as a result of a drop in pressure on the liquid ejecting head side; a check valve that is provided in the first liquid flow channel closer to the liquid supply source than the pressure control valve and that prevents backflow from the pressure control valve side toward the liquid supply source side; a second liquid flow channel, whose one end is connected to a connection portion (C2) on the pressure control valve side and whose other end is connected to a connection portion (C1) on the check valve side between the pressure control valve and the check valve in the first liquid flow channel, that with the first liquid flow channel configures a circulating flow channel in which the liquid circulates; a circulating pump that is provided in the second liquid flow channel and that causes the liquid to flow in the circulating flow channel; and a liquid reservoir portion that is provided in an area of at least one of the first liquid flow channel and the second liquid flow channel between the check valve and the connection portion on the pressure control valve side and that is capable of holding the liquid in the liquid flow channel in a pressurized state.

According to this configuration, even if the amount of liquid within the circulating flow channel increases as a result of the liquid flowing into the circulating flow channel from the upstream side, which corresponds to the liquid supply source side, via the check valve as a result of a depressurized state occurring in the liquid flow channel produced when the circulating pump operates, the increased liquid is temporarily held in the liquid reservoir portion in a pressurized state. As a result, even if the amount of liquid within the circulating flow channel increases, the pressure within the circulating flow channel is held constant by the increased pressure in the liquid reservoir portion, and thus a rise in the pressure of the liquid within the circulating flow channel can be suppressed. In addition, the depressurized state occurring in the liquid flow channel when the pump operates is counteracted by the liquid held in the liquid reservoir portion in a pressurized state, and the liquid can be suppressed from flowing into the circulating flow channel from the upstream side, which corresponds to the liquid supply source side.

According to another aspect of the invention, in the liquid ejecting apparatus, it is preferable that the liquid reservoir portion be provided in at least one of the first liquid flow channel and the second liquid flow channel between the connection portion (C2) on the pressure control valve side and the connection portion (C1) on the check valve side.

According to this configuration, the liquid reservoir portion is positioned between the connection portion (C2) on the pressure control valve side and the connection portion (C1) on the check valve side in an area that is downstream from the circulating pump when the circulating pump operates, and thus a depressurized state of the liquid produced in the liquid flow channel by operation of the circulating pump can be immediately suppressed by the liquid that is pressurized in the liquid reservoir portion. Accordingly, by suppressing the depressurized state produced in the liquid flow channel that is downstream in the direction in which the liquid flows when the circulating pump operates, the depressurization acting on the check valve can be efficiently suppressed, and the liquid can be prevented from flowing into the circulating flow channel from the liquid supply source side.

According to another aspect of the invention, in the liquid ejecting apparatus, it is preferable that a plurality of the liquid reservoir portions be provided in the circulating flow channel.

According to this configuration, in the case where there has been a large increase in the amount of liquid that flows into the circulating flow channel from the upstream side, which corresponds to the liquid supply source side, the increased liquid is distributed among and held in the plurality of liquid reservoir portions, which makes it possible to suppress a rise in the pressure within the circulating flow channel.

According to another aspect of the invention, in the liquid ejecting apparatus, it is preferable that the plurality of liquid reservoir portions be provided in respective flow channel areas that configure the first liquid flow channel in the circulating flow channel and that are connected in parallel between the pressure control valve and the check valve.

According to this configuration, in the case where the amount of liquid that flows into the circulating flow channel from the upstream side, which corresponds to the liquid supply source side, has increased suddenly, the increased liquid can be simultaneously distributed among and held in the liquid reservoir portions that are provided in parallel, which makes it possible to suppress a rise in the pressure within the circulating flow channel.

According to another aspect of the invention, in the liquid ejecting apparatus, it is preferable that the circulating pump cause the liquid to flow in the first liquid flow channel within the circulating flow channel in a direction opposite to the direction in which the liquid flows through the first liquid flow channel when the liquid is supplied to the liquid ejecting head.

According to this configuration, the liquid that flows through the circulating flow channel flows in the opposite direction as the direction in which the liquid flows through the first liquid flow channel during normal use of the liquid ejecting apparatus, and thus the liquid can be effectively agitated in the first liquid flow channel.

According to another aspect of the invention, in the liquid ejecting apparatus, it is preferable that the circulating pump start operating in a state where the liquid is not held in the liquid reservoir portion and cause the liquid to flow within the circulating flow channel.

According to this configuration, the liquid reservoir portion holds the liquid that flows into the circulating flow channel after being in an empty state in which no liquid is held, and thus an increased amount of liquid within the circulating flow channel can be held with certainty. Accordingly, a rise in the pressure of the liquid within the circulating flow channel can be suppressed with a high rate of success.

BRIEF DESCRIPTION OF THE DRAWINGS

The invention will be described with reference to the accompanying drawings, wherein like numbers reference like elements.

FIG. 3A is a diagram illustrating a state in which ink circulates through the circulating flow channel due to pressurization by a tube pump, and FIG. 3B is a diagram illustrating a state in which ink flows into the circulating flow channel due to depressurization by the tube pump.

FIG. 4A is a diagram illustrating a state in which ink circulates through the circulating flow channel due to pressurization by a tube pump, and FIG. 4B is a diagram illustrating a state in which ink flows into the circulating flow channel due to depressurization by the tube pump.

FIG. 5A is a graph illustrating differences in pressure fluctuations of ink within a circulating flow channel caused by the presence/absence of a return flow channel, whereas FIG. 5B is a comparative table that illustrates the differences in flow states of ink caused by the presence/absence of a return flow channel as ratios.

FIG. 9A is a diagram illustrating a state in which ink is circulated through the circulating flow channel by a tube pump, and FIG. 9B is a diagram illustrating a state in which ink flows into the circulating flow channel from an ink cartridge side.

DESCRIPTION OF EXEMPLARY EMBODIMENTS

Hereinafter, an ink jet printer (also referred to simply as a "printer" hereinafter) embodying a liquid ejecting apparatus according to the invention will be described with reference to the drawings. The printer according to this embodiment forms images and the like, including text and graphics, on a medium transported in a single direction, by ejecting a liquid supplied from a liquid supply source from a liquid ejecting head.

Figure 1:
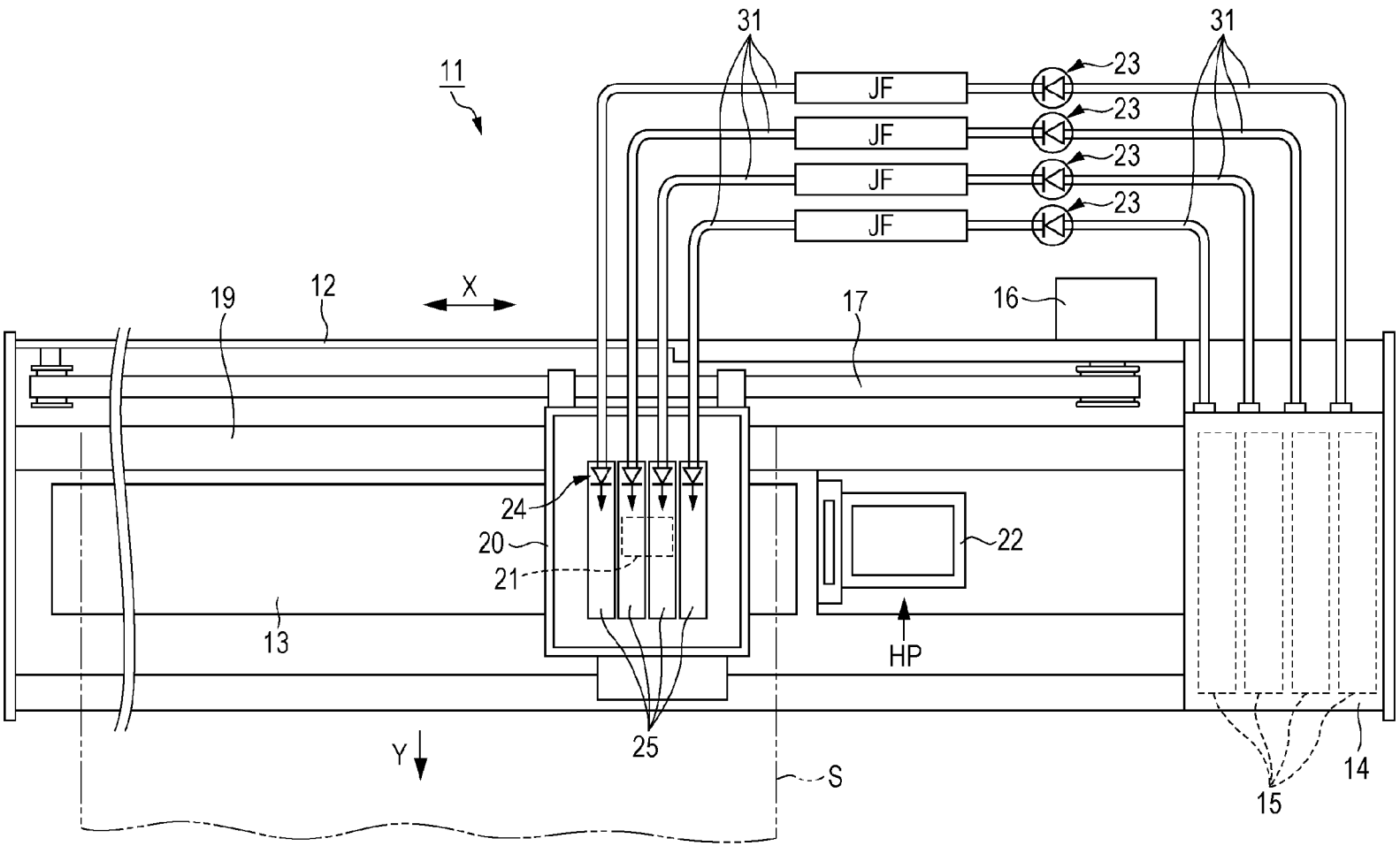
FIG. 1 is a general block diagram illustrating a printer embodying a liquid ejecting apparatus according to the invention.

As shown in FIG. 1, in a printer 11 serving as an example of the liquid ejecting apparatus, a support member 13, for supporting paper S serving as an example of the medium during image formation, or in other words, during printing, extends along a lengthwise direction X on the lower side in a gravitational direction within a frame 12 having an approximate box shape. A paper feed mechanism (not shown) is driven based on the driving of a paper feed motor (not shown) provided below a rear side of the frame 12, which corresponds the opposite direction as a transport direction Y of the paper S; the paper S is transported by this paper feed mechanism upon the support member 13 in a widthwise direction (forward direction) of the support member 13.

In addition, a plurality (four, here) of ink cartridges 15, each of which serves as an example of a liquid holding member that holds ink serving as an example of a liquid, are provided, as a liquid supply source, in a removable state in a cartridge holder 14 that is disposed on one end side of the lengthwise direction X of the frame 12 (in this embodiment, the right end side, when viewed from the front of the transport direction Y). Note that in this embodiment, each of the ink cartridges 15 hold mutually different colors of ink, and are mounted in the cartridge holder 14. In addition, each of the ink cartridges 15 holds a pigment ink.

A guide shaft 19 that extends along the lengthwise direction X is erected within the frame 12, and a carriage 20 is supported in a slidable state on the guide shaft 19. The carriage 20 is affixed to one part of an endless timing belt 17 that is rotationally driven by a carriage motor 16 provided on the upstream side (the rear side) of the frame 12 in the transport direction. Accordingly, the carriage 20 moves back and forth along the guide shaft 19 in the lengthwise direction X, which corresponds to a scanning direction, as a result of the timing belt 17 being driven by the driving of the carriage motor 16. Meanwhile, a liquid ejecting head 21 in the bottom surface of which a plurality of ejecting nozzles (not shown) that eject ink are provided, and a plurality (four, here) of valve units 25 that are provided corresponding to respective ink cartridges 15 and that control the supply of ink to the liquid ejecting head 21, are mounted in the carriage 20.

In the frame 12, one end side (in this embodiment, the right end side when viewed from the transport direction) in the movement range of the carriage 20 along the scanning direction corresponds to a non-medium ejecting region that is outside of a medium ejecting region, and a home position HP is provided in this region. A maintenance unit 22 for performing various types of maintenance processes on the liquid ejecting head 21 is provided in this home position HP.

When the liquid ejecting head 21 has moved to the home position HP, the maintenance unit 22 raises a cap (not shown) and brings the cap into contact with the liquid ejecting head 21 from below; an airtight space formed as a result of that contact is then depressurized using a suction pump (not shown), and ink is sucked from the ejecting nozzles as a result. Alternatively, ink is forcefully ejected from the ejecting nozzles of the liquid ejecting head 21 that has moved to the home position HP, and the ejected ink is then collected. By doing so, the maintenance unit 22 performs maintenance for stabilizing the operations for ejecting ink from the ejecting nozzles by, for example, expelling thickened ink from the ejecting nozzles.

In this embodiment, ink supply tubes 31 are provided as first liquid flow channels. The ink supply tubes 31 serving as the first liquid flow channels are connected at one end to respective ink cartridges 15 serving as the liquid supply source, and, in the case where it is assumed that the ink cartridges 15 are on the upstream side, are connected at the other end to the liquid ejecting head 21 via the valve units 25 that are positioned downstream from the ink cartridges 15. Accordingly, ink is supplied from the respective ink cartridges 15 to the liquid ejecting head 21 by the ink supply tubes 31.

A pressure control valve 24 that functions as what is known as a self-sealing valve, by opening in the case where ink has been ejected from the ejecting nozzles and the pressure of the ink has dropped and supplying ink to the liquid ejecting head 21 (the ejecting nozzles) from upstream, is provided in each of the valve units 25. The ink supply tubes 31 are connected on the upstream side of corresponding pressure control valves 24.

Furthermore, a check valve 23 including an on/off valve 23*a* is provided upstream from the pressure control valve 24 in each of the ink supply tubes 31. The on/off valve 23*a* opens in the case where ink flows from the ink cartridge 15 on the upstream side toward the pressure control valve 24 on the downstream side, but closes when ink attempts to flow from the pressure control valve 24 on the downstream side toward the ink cartridge 15 on the upstream side, and prevents that flow as a result.

Furthermore, although illustrated as a block in FIG. 1, a second liquid flow channel that is connected at both ends to the ink supply tube 31 is provided in each of the ink supply tubes 31, and a circulating flow channel JF is formed with the ink supply tube 31 by the second liquid flow channel; the ink supply tubes 31 and the circulating flow channels JF in the vicinity of the liquid ejecting head 21 move along with the carriage 20. Furthermore, a return flow channel KF is formed by a third liquid flow channel whose one end is connected to a flow channel area in the circulating flow channel JF and whose other end is connected to the ink supply tube 31.

Figure 2:
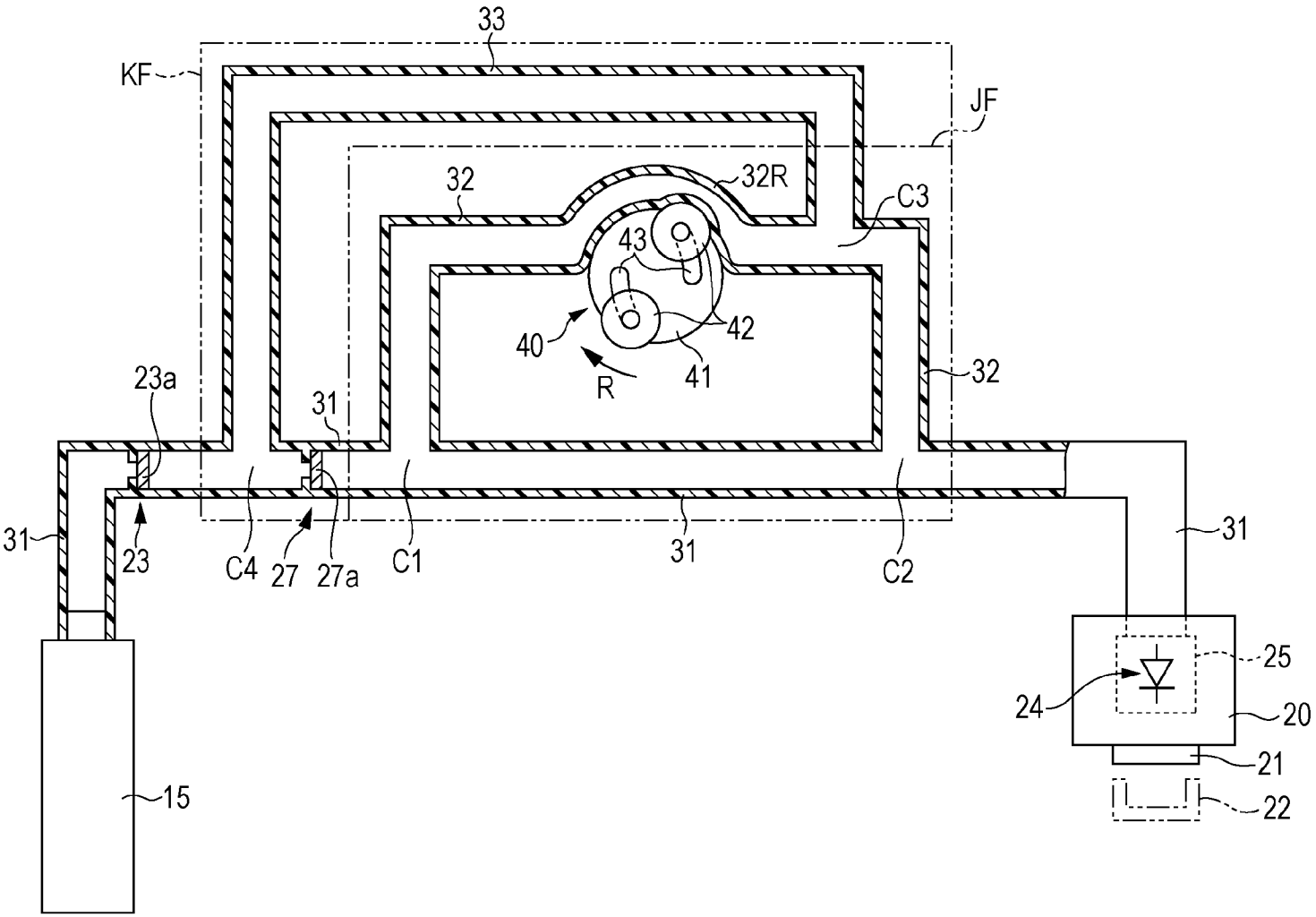
FIG. 2 is a schematic diagram illustrating the configuration of a liquid flow channel in which a circulating flow channel and a return flow channel are provided, in a printer according to an embodiment.

The circulating flow channel JF and the return flow channel KF will be described with reference to FIG. 2. In this embodiment, each circulating flow channel JF and return flow channel KF have the same configuration in each of the ink cartridges 15. Accordingly, only a single circulating flow channel JF and return flow channel KF will be described here as representative examples. For this reason, FIG. 2 schematically illustrates a single circulating flow channel JF and return flow channel KF, including other constituent elements. Meanwhile, although the respective constituent elements that configure the circulating flow channel JF and the return flow channel KF are illustrated in FIG. 2 as being a continuous member, in reality, these flow channels are formed of a plurality of members that are connected to each other. Furthermore, in reality, the liquid ejecting head 21 and the ink cartridges 15 are disposed at different elevations in the gravitational direction, and the manner in which the ink supply tubes 31 and circulating flow channels JF that are connected therebetween are disposed in the gravitational direction will be described later as a variation with reference to FIG. 12.

As shown in FIG. 2, the circulating flow channel JF includes an ink circulation tube 32, serving as the second liquid flow channel, that is connected at both ends to the ink supply tube 31 by connection portions C1 and C2; the circulating flow channel JF is formed so that ink circulates between the ink circulation tube 32 and the ink supply tube 31. A tube pump 40 that performs pump operations for causing the ink to flow in one direction in the circulating flow channel JF is provided in the ink circulation tube 32 as a circulating pump.

In the tube pump 40, an elastic tube (here, part of the ink circulation tube 32) is supported in an arc shape as a curved portion 32R, and is squeezed by rollers 42 provided in a mobile state on a rotating member 41, as a result of the rotating member 41 being rotated in one direction by a driving source. The ink is pushed in the rotation direction by the rollers 42 rotating (revolving) while continuing to squeeze the tube, and the ink is caused to flow in one direction within the circulating flow channel JF as a result. In other words, when the rollers 42 rotate in the direction indicated by an arrow R in FIG. 2 and advance into the curved portion 32R, the rollers 42 squeeze the ink circulation tube 32 by moving along a guide hole 43 and away from the rotational center of the rotating member 41. The ink within the ink circulation tube 32 enters a pressurized state as a result of the squeezing. Then, as a result of the rollers 42 rotating (revolving) along the curved portion 32R with the rotating member 41 while squeezing the ink circulation tube 32, the ink within the ink circulation tube 32 is pushed in the rotational direction of the rollers 42 while being pressurized, and is caused to flow in one direction within the circulating flow channel JF.

After this, when the rollers 42 rotate (revolve) and move away from the curved portion 32R of the ink circulation tube 32, the rollers 42 that have stopped squeezing the ink circulation tube 32 are moved toward the rotational center along the guide hole 43 by a resistive force acting against the squeezing. As a result, the ink circulation tube 32 returns suddenly to its original shape from the squeezed shape, and the ink within the ink circulation tube 32 enters a depressurized state as a result of the tube returning to its original shape. In this manner, the tube pump 40 is a circulating pump that, while operating, produces pressure fluctuations (pulsations), between a pressurized state and a depressurized state, in the ink within the ink circulation tube 32.

The return flow channel KF includes an ink return tube 33, serving as the third liquid flow channel, connected at one end by a connection portion C3 to a flow channel area of the ink circulation tube 32 that is located on the side of the tube pump 40 toward which the ink flows as a result of the pump operations. Meanwhile, a check valve 27 including an on/off valve 27*a* that opens in the case where ink flows from the check valve 23 downstream toward the connection portion C1 and that closes in the case where ink flows from the connection portion C1 upstream toward the check valve 23 is provided in the ink supply tube 31 between the check valve 23 and the connection portion C1. The other end of the ink return tube 33 is connected by a connection portion C4 to a flow channel area in the ink supply tube 31 that is located further upstream, toward the ink cartridge 15, than the check valve 27 and is located further downstream than the check valve 23. Through this, the return flow channel KF returns the ink from the circulating flow channel JF to an area further toward the ink cartridge 15 that serves as the liquid supply source (that is, further upstream) than the check valve 27, through the ink return tube 33.

Next, ink agitation operations performed by the printer 11 according to this embodiment, in which the circulating flow channel JF and the return flow channel KF are provided in the ink supply tube 31 in this manner, will be described. First, however, to facilitate understanding of the agitation operations performed in this embodiment, ink agitation operations performed in a printer 11 in which only the circulating flow channel JF is provided and the return flow channel KF is omitted, will be described as a comparative example with reference to FIGS. 3A and 3B.

Figure 3A:
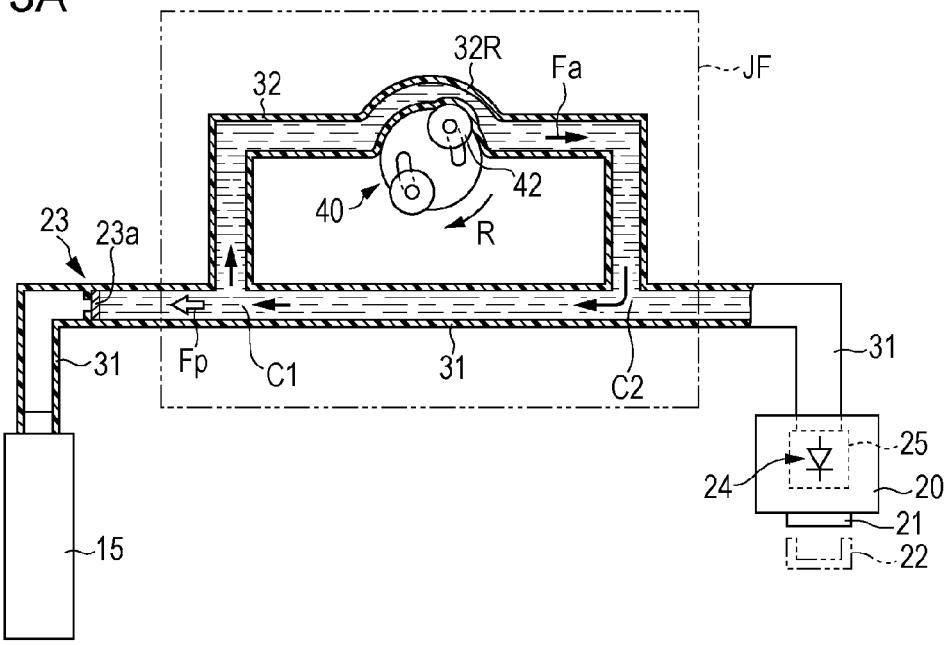
FIGS. 3A and 3B are schematic diagrams illustrating ink circulating operations in a circulating flow channel in which a return flow channel is not provided, where

As shown in FIG. 3A, during pump operations, in which the rollers 42 in the tube pump 40 advance into the curved portion 32R of the ink circulation tube 32 and rotate while squeezing the ink circulation tube 32, the ink pushed out from the curved portion 32R is pressurized in the ink circulation tube 32, and flows in the direction indicated by the solid line arrow Fa in FIG. 3A. As a result, the ink flows in the opposite direction as the direction in which the ink flows when the ink is supplied to the liquid ejecting head 21, or in other words, flows in the direction from downstream to upstream, between the connection portions C1 and C2 in the ink supply tube 31 that configures the circulating flow channel JF with the ink circulation tube 32.

At this time, the pressure of the ink downstream from the check valve 23 rises due to the ink flowing from downstream to upstream in the ink supply tube 31 as a result of the operations of the tube pump 40, and thus a pressure is produced toward the check valve 23, as indicated by the white arrow Fp in FIG. 3A. Accordingly, the on/off valve 23*a* closes, and the ink is prevented from flowing from the ink cartridge 15 toward the circulating flow channel JF. Furthermore, the flow channel leading toward the liquid ejecting head 21 is closed due to the pressure control valve 24, and thus ink will not flow toward the liquid ejecting head 21 even if the pressure of the ink rises in the ink supply tube 31.

Figure 3B:
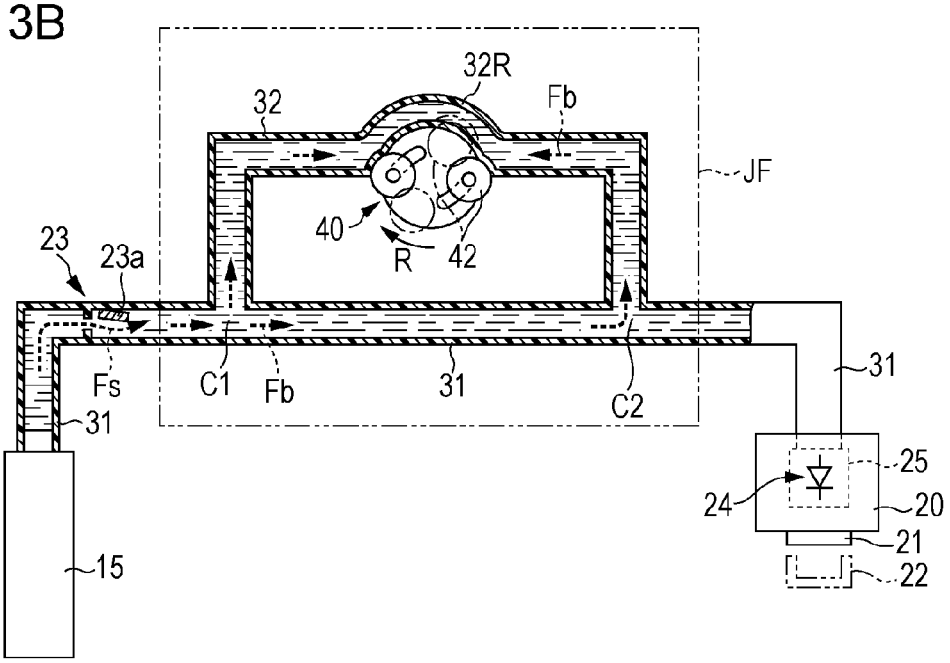

Next, as shown in FIG. 3B, when the rollers 42 in the tube pump 40 rotate (revolve) further and move away from the curved portion 32R in the ink circulation tube 32, the ink circulation tube 32 that was being squeezed by the rollers 42 returns to its original shape, and as a result, the ink within the curved portion 32R is depressurized. Accordingly, in the circulating flow channel JF, the ink flows in the direction from the connection portion C2 toward the curved portion 32R, as indicated by the broken line arrow Fb in FIG. 3B. Note that when the ink flows from the connection portion C1 toward the curved portion 32R along the ink circulation tube 32 at this time, the flow is maintained in essentially the same direction although changes occur in the flow velocity.

As a result, the ink flows from the connection portion C1 toward the connection portion C2 as indicated by the broken line arrow Fb in FIG. 3B in the ink supply tube 31, in the same manner as in the ink circulation tube 32; because the ink located downstream from the check valve 23 is pulled in, the pressure downstream from the check valve 23 drops. Accordingly, the ink flows into the circulating flow channel JF from the ink cartridge 15 via the check valve 23, as indicated by the broken line arrow Fs in FIG. 3B. Meanwhile, because the ink flow channel on the side of the liquid ejecting head 21 is closed by the pressure control valve 24, the ink does not flow (flow back) from the liquid ejecting head 21 even if the pressure of the ink drops in the ink supply tube 31 and the ink is depressurized. As a result, a predetermined amount of ink flows downstream from the ink cartridge 15 via the check valve 23 and accumulates in the ink flow channel between the check valve 23 and the pressure control valve 24, or in other words, in the ink supply tube 31 and the circulating flow channel JF.

Accordingly, if the ink continues to be agitated by operating the tube pump 40, this phenomenon, in which the predetermined amount of ink flows downstream from the ink cartridge 15 via the check valve 23, will occur each time a pressure fluctuation occurs in the ink due to the operation of the tube pump 40. In other words, the circulating flow state of the ink illustrated in FIG. 3A and the state in which the ink flows in from the ink cartridge 15 illustrated in FIG. 3B will occur repeatedly. Accordingly, the ink that flows in from the ink cartridge 15 will gradually accumulate and increase in the ink flow channel between the check valve 23 and the pressure control valve 24, and the pressure of the ink within the circulating flow channel JF will rise. As a result, as described earlier, in the case where the circulating flow channel JF is, for example, formed by connecting a plurality of flow channel members, the connections between the flow channel members can become disengaged, or the flow channel members themselves can rupture.

Accordingly, in the present embodiment, a rise in the pressure of the ink within the circulating flow channel JF produced during ink agitation operations is suppressed by providing the return flow channel KF in addition to the circulating flow channel JF. Hereinafter, ink agitation operations performed by the printer 11 according to this embodiment will be described with reference to FIGS. 4A and 4B.

Figure 4A:
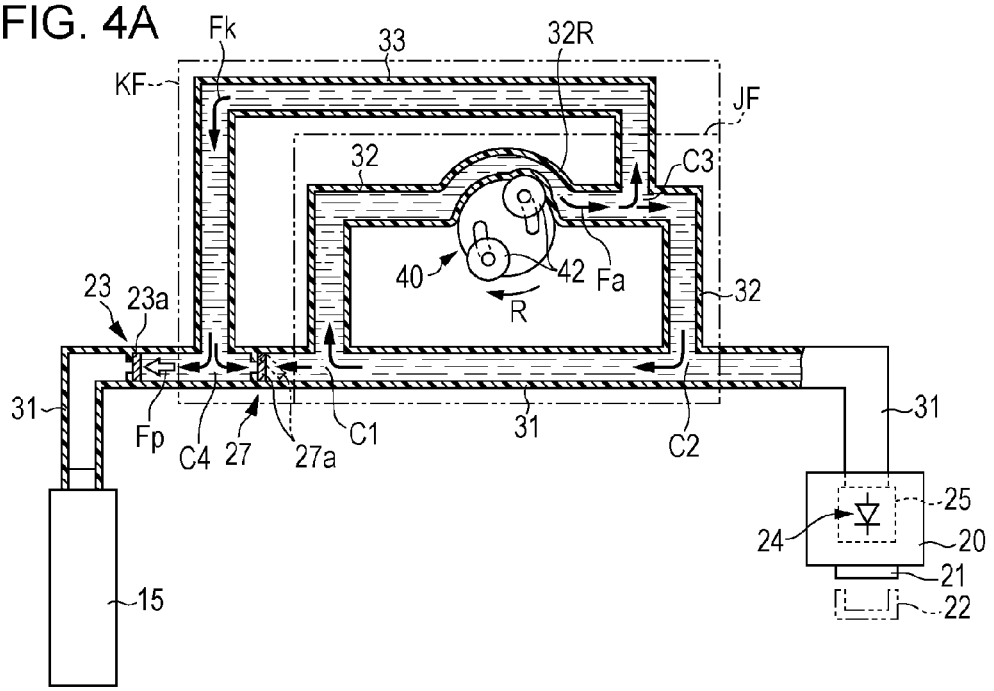
FIGS. 4A and 4B are schematic diagrams illustrating ink circulating operations in a circulating flow channel in which a return flow channel is provided, where

As shown in FIG. 4A, during pump operations, in which the rollers 42 in the tube pump 40 rotate while squeezing the curved portion 32R of the ink circulation tube 32, the ink that is pressurized and pushed out from the curved portion 32R undergoes a circulatory flow, flowing through the circulating flow channel JF in one direction, as indicated by the solid line arrow Fa in FIG. 4A. In other words, the ink flowing through the ink circulation tube 32 flows toward the connection portion C2, flowing into the downstream side of the ink supply tube 31.

At this time, some of the ink that flows through the ink circulation tube 32 flows from the connection portion C3 to the ink return tube 33. Accordingly, the amount of ink that flows from the connection portion C2 on the downstream side in the ink supply tube 31 toward the connection portion C1 on the upstream side flows into the ink return tube 33 at the connection portion C3, and thus is less than the amount of ink pushed out of the curved portion 32R by an amount equivalent to the amount that flows into the ink return tube 33.

Some of the ink that flows into the ink return tube 33 from the ink circulation tube 32 via the connection portion C3 flows toward the connection portion C4 as indicated by the solid line arrow Fk in FIG. 4A, and flows into a flow channel area of the ink supply tube 31 located downstream from the check valve 23 and upstream from the check valve 27. As a result, the ink pressure in the ink supply tube 31 upstream from the check valve 27 rises due to the ink that flows in from the ink return tube 33 via the connection portion C4. Meanwhile, downstream from the check valve 27, the ink pressure rises due to the ink that flows through the ink supply tube 31 from the downstream side toward the upstream side. Accordingly, the check valve 27 increases the ink pressure both upstream and downstream therefrom.

At this time, in the case where the ink pressure upstream from the check valve 27 is greater than the ink pressure downstream from the check valve 27, the on/off valve 27*a* opens as indicated by the double-dot-dash line in FIG. 4A, ink flows from the connection portion C4 toward the connection portion C1 via the check valve 27, and flows into the circulating flow channel JF. As a result of this ink flow, the ink pressure downstream from the check valve 27 rises, and the ink merges with the ink flowing in the ink supply tube 31 from the downstream side of the connection portion C1; the ink then flows toward the curved portion 32R from the connection portion C1 along the ink circulation tube 32. When the pressure downstream from the check valve 27 and the pressure upstream from the check valve 27 become essentially the same or the downstream pressure becomes greater, the on/off valve 27*a* of the check valve 27 closes as indicated by the solid line in FIG. 4A, and the flow of ink from the connection portion C4 toward the connection portion C1 stops.

As a result, the ink is held in the ink return tube 33 and in the ink supply tube 31 between the check valve 23 and the check valve 27 in a pressurized state. Accordingly, in the circulating flow channel JF between the ink circulation tube 32 and the ink supply tube 31, the ink does not flow in from the ink return tube 33 via the check valve 27, and a constant amount of ink is circulated as a result of the operations of the tube pump 40.

When a constant amount of ink is circulating in the circulating flow channel JF in this manner, the ink located toward the connection portion C4, which is downstream from the check valve 23, is maintained in a pressurized state by the ink pushed out by the tube pump 40 via the ink return tube 33. Accordingly, the on/off valve 23*a* is pressurized as indicated by the white arrow Fp in FIG. 4A, and the check valve 23 is closed; as a result, ink flow into the ink flow channel from the ink cartridge 15 between the check valve 23 and the pressure control valve 24, or in other words, ink flow into the return flow channel KF and the circulating flow channel JF, is essentially prevented.

Figure 4B:
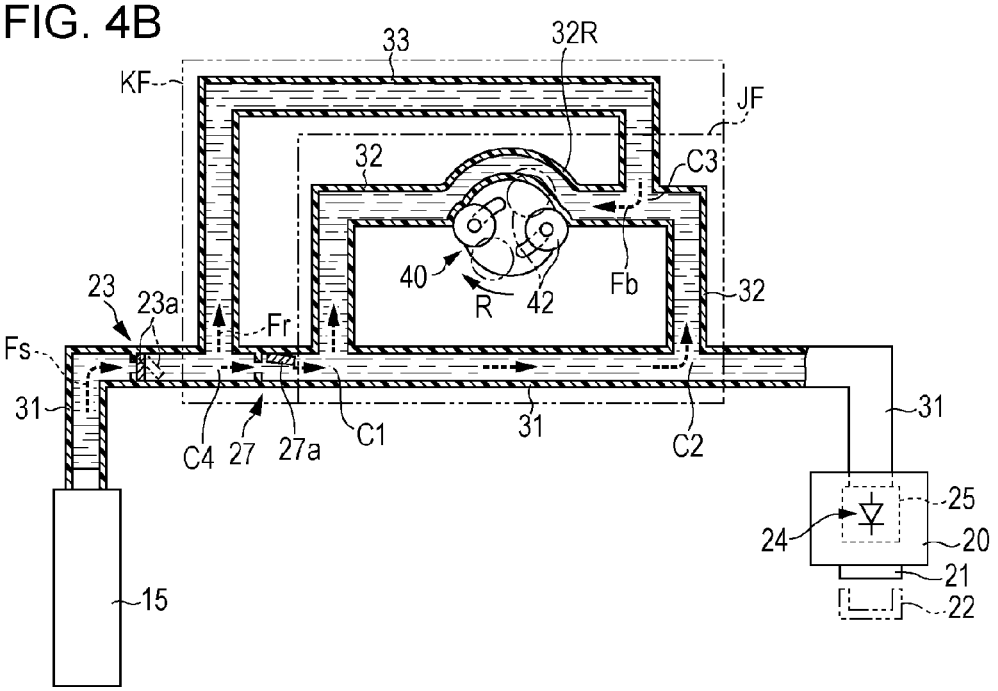

Next, as shown in FIG. 4B, when the rollers 42 in the tube pump 40 rotate further and move away from the curved portion 32R in the ink circulation tube 32, the ink circulation tube 32 that was being squeezed by the rollers 42 returns to its original shape, and as a result, the ink is depressurized. Accordingly, in the circulating flow channel JF, the ink flows in the direction from the connection portion C2 and the connection portion C3 toward the curved portion 32R, as indicated by the broken line arrow Fb in FIG. 4B. Note that when the ink flows from the connection portion C1 toward the curved portion 32R along the ink circulation tube 32, the flow is maintained in essentially the same direction although changes occur in the flow velocity.

As a result, in the same manner as in the comparative example, the ink flows from the connection portion C1 toward the connection portion C2 in the ink supply tube 31; because this ink flow attempts to pull the ink located downstream from the check valve 27, the pressure downstream from the check valve 27 drops (that is, the ink is depressurized), and the on/off valve 27*a* is opened as a result.

At this time, in this embodiment, an ink flow is produced in the ink return tube 33, from the connection portion C4, where the ink is held in a pressurized state, toward the connection portion C3, where the ink is in a depressurized state, as indicated by the arrow Fr in FIG. 4B, unlike in the comparative example. Accordingly, in the ink supply tube 31, the amount of ink that flows from the connection portion C1 toward the connection portion C2 due to the ink flowing into the ink circulation tube 32 from the ink return tube 33 via the connection portion C3 is suppressed to a smaller amount than in the comparative example. As a result, the amount of ink that flows into the circulating flow channel from the connection portion C4 via the check valve 27 is also suppressed compared to the comparative example.

Furthermore, in this embodiment, the ink that flows toward the connection portion C1 via the connection portion C3 or the check valve 27 is ink that is returned from the circulating flow channel JF in the ink return tube 33 and in the ink supply tube 31 between the check valve 23 and the check valve 27, and is thus ink that is held in a pressurized state. Accordingly, a drop in the pressure (that is, depressurization) of the ink downstream from the check valve 23 is suppressed more than in the comparative example. As a result, due to the on/off valve 23*a* opening as indicated by the double-dot-dash line in FIG. 4B, the amount of ink that flows toward the connection portion C4 from the ink cartridge 15 via the check valve 23 as indicated by the broken line arrow Fs in FIG. 4B is suppressed to a lower amount than in the comparative example. Note that there are also cases where the ink that flows toward the connection portion C4 from the ink cartridge 15 is included in the ink that is returned from the circulating flow channel JF and held in a pressurized state and flows into the circulating flow channel JF via the check valve 27.

In this embodiment, as a result of the ink agitation operations being continued, an operating state in which the rollers 42 advance into the curved portion 32R of the ink circulation tube 32 as shown in FIG. 4A and an operating state in which the rollers 42 separate from the curved portion 32R of the ink circulation tube 32 as shown in FIG. 4B are repeated. The amount of ink that flows into the return flow channel KF (the circulating flow channel JF) from the ink cartridge 15 via the check valve 23 each time these operating states are repeated is suppressed to a lower amount than in the comparative example. As a result, a rise in the ink pressure in the circulating flow channel JF is suppressed, and the amount by which the ink that flows into and accumulates in the return flow channel KF (circulating flow channel JF) from the ink cartridge 15 via the check valve 23 increases is suppressed to a lower amount than in the comparative example, in which the return flow channel KF is not provided.

An example of a result of these suppression effects will be described with reference to FIGS. 5A and 5B.

Figures 5A, 5B:
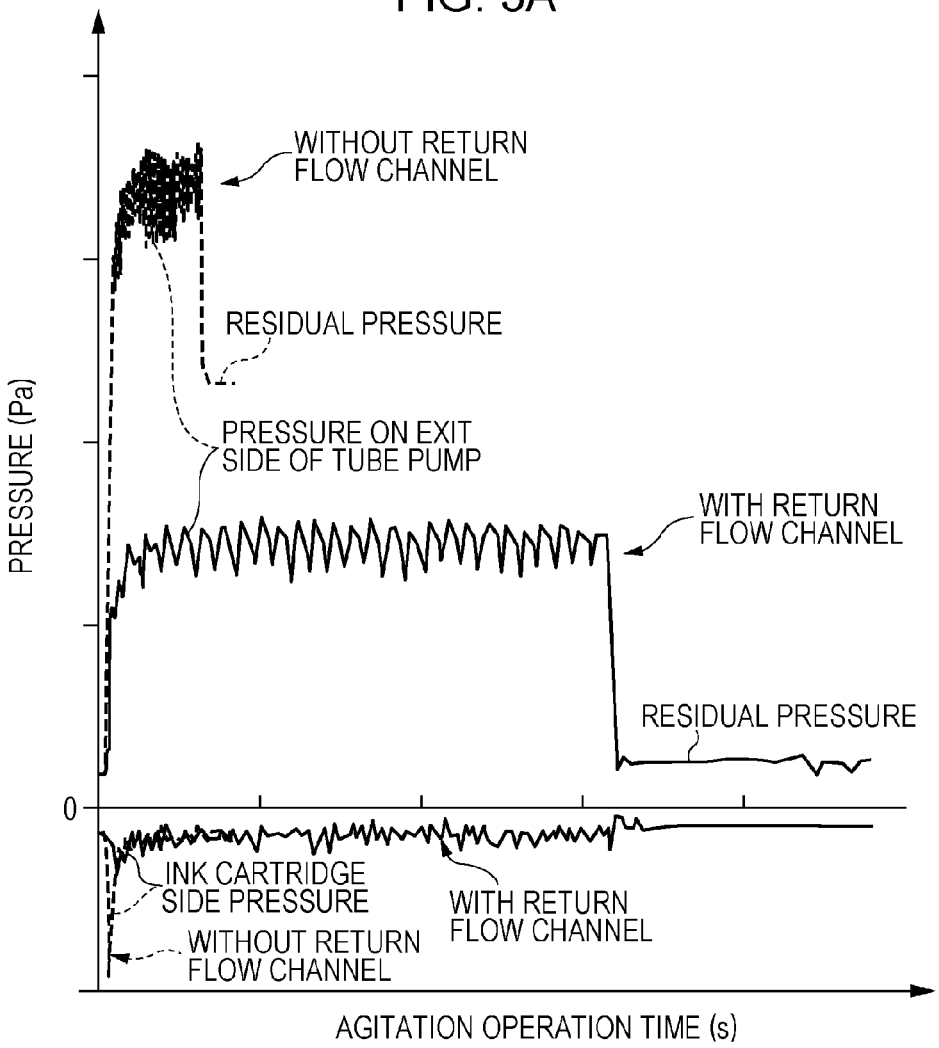

As shown in FIG. 5A, the ink pressure within the circulating flow channel JF on an exit side of the tube pump 40 from which the ink is pushed out due to operations of the tube pump 40 drops to a value in this embodiment, in which the return flow channel is provided as indicated by the solid line in FIG. 5A, that is less than half of the value in the comparative example, in which the return flow channel is not provided as indicated by the broken line in FIG. 5A. In addition, residual pressure within the circulating flow channel JF at the point in time when the ink agitation operations have ended has a considerably lower value in this embodiment than the value in the comparative example.

Furthermore, the ink pressure (negative pressure) downstream from the check valve 23 and upstream from the check valve 27 (that is, toward the ink cartridge 15) has a considerably lower value in this embodiment, in which the return flow channel KF is provided as indicated by the solid line in FIG. 5A, than the value in the comparative example, in which the return flow channel KF is not provided as indicated by the broken line in FIG. 5A, particularly at the point in time when the ink agitation operations are started. Based on this, it can be seen that the ink that flows from the ink cartridge 15 via the check valve 23 is suppressed by providing the return flow channel KF.

Incidentally, results of performing the ink agitation operations according to this embodiment are illustrated in the chart in FIG. 5B as ratios, with the comparative example being taken as 100%. As shown in FIG. 5B, in this embodiment, the pressure on the exit side of the tube pump 40 is suppressed to 44%, the maximum negative pressure on the ink cartridge 15 side is suppressed to 36%, and the amount of ink that flows from the ink cartridge 15 is suppressed to 22.5% of the values in the comparative example.

According to the embodiment described thus far, the following effects can be achieved.

1. Even if ink flows into the circulating flow channel JF from the upstream side, which is the side toward the ink cartridge 15, via the check valve 27 when the tube pump 40 is operated, the ink that flows in at that time is ink that includes ink returned to the upstream side of the check valve 27 from the circulating flow channel JF by the ink return tube 33. Accordingly, an increase in the ink within the circulating flow channel JF is suppressed more than in the case where the ink return tube 33 is not provided, which makes it possible to suppress a rise in the pressure of the ink within the circulating flow channel JF.

2. The ink return tube 33 is connected to a flow channel area in the ink circulation tube 32 that is further toward one direction than the tube pump 40, and thus ink that is pressurized by the tube pump 40 and that flows in the one direction as a result can be returned upstream, toward the ink cartridge 15, with certainty via the ink return tube 33. Accordingly, a rise in the pressure of the ink within the circulating flow channel JF can be suppressed with a high rate of success.

The aforementioned embodiment may be changed to the embodiments described hereinafter as well.

In the aforementioned embodiment, the return flow channel KF may, in addition to the ink return tube 33, be further provided with an ink flow channel (a fourth liquid flow channel) that returns ink from the circulating flow channel JF toward the ink cartridge 15. This variation will be described with reference to FIG. 6.

Figure 6:
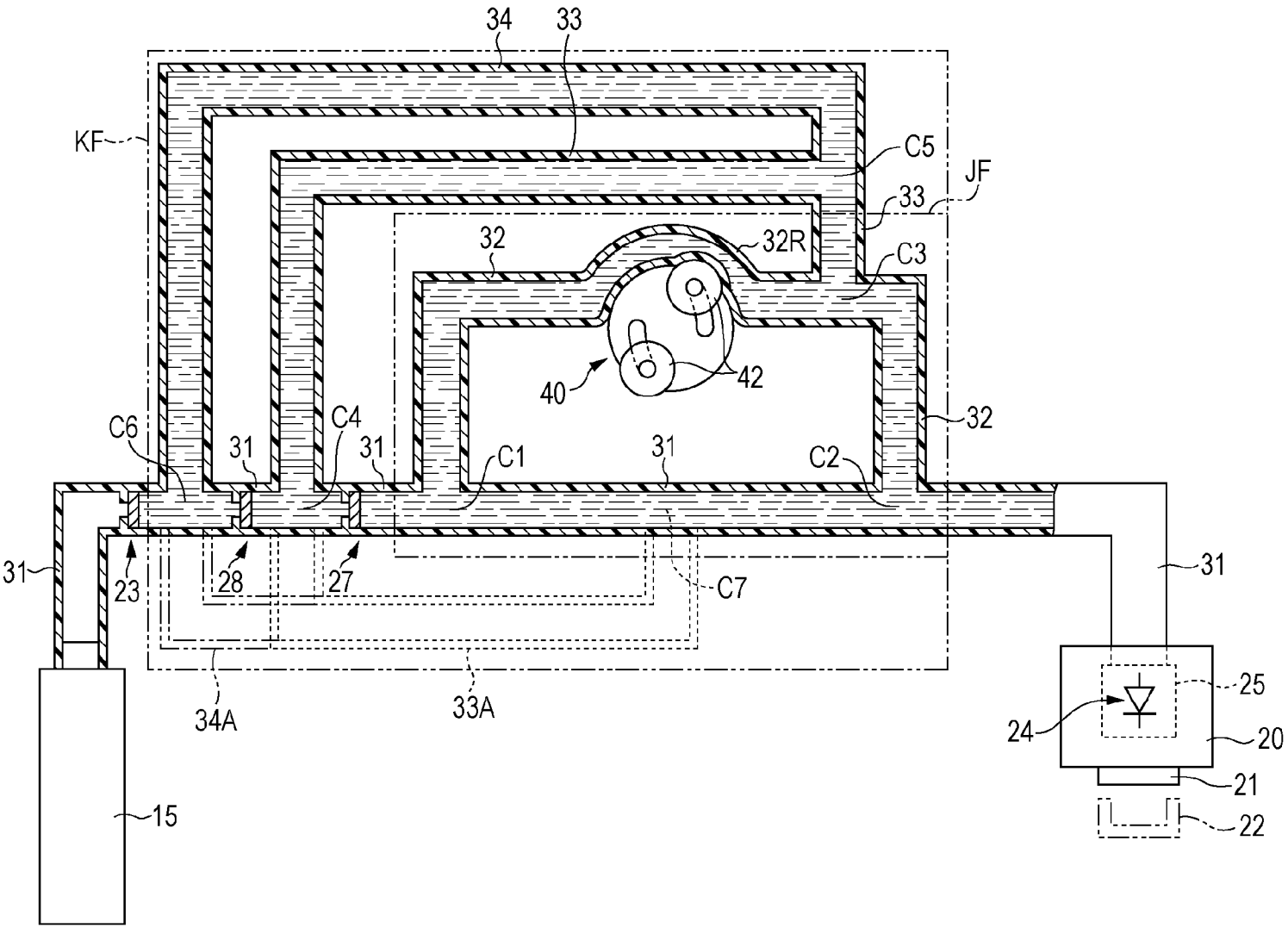
FIG. 6 is a schematic diagram illustrating a variation on a liquid flow channel, in which a plurality of return flow channels are provided.

As shown in FIG. 6, in this variation, assuming that the check valve 27 serves as a first check valve, a check valve 28 serving as a second check valve is provided in the ink supply tube 31 further upstream, toward the ink cartridge 15, than the connection portion C4, which corresponds to a flow channel area where the other end of the ink flow channel serving as the ink return tube 33 is connected. An ink return sub tube 34 is then provided serving as the fourth liquid flow channel, one end of which is connected to the ink return tube 33 by a connection portion C5, and the other end of which is connected by a connection portion C6 to a flow channel area in the ink supply tube 31 that is further upstream toward the ink cartridge 15 than the check valve 28 and further downstream from the check valve 23.

By providing the ink return sub tube 34 in this manner, some of the ink that is pressurized by the operations of the tube pump 40, pushed out from the curved portion 32R, and that flows through the ink circulation tube 32 flows into the ink return tube 33 and the ink return sub tube 34 from the connection portion C3. As a result, the amount of ink that flows from the connection portion C2 on the downstream side of the ink supply tube 31 toward the connection portion C1 on the upstream side of the ink supply tube 31 can be further reduced compared to the amount of ink that flows in the aforementioned embodiment. Accordingly, the ink that flows into the circulating flow channel JF on the downstream side from the upstream side of the check valve 27 via the check valve 27 increases.

At this time, in this variation, the ink that is in a pressurized state flows into the circulating flow channel JF from the ink return tube 33 in the same manner as the aforementioned embodiment, and the ink that is in a pressurized state flows toward the connection portion C4 on the downstream side from the ink return sub tube 34 via the check valve 28. Accordingly, the ink that flows into the circulating flow channel JF via the check valve 27 can essentially be ink that is returned from the circulating flow channel JF to the upstream side of the check valve 27 via the return flow channel KF.

In addition, the ink that flows into the ink return tube 33 from the ink circulation tube 32 via the connection portion C3 and the ink that flows into the ink return sub tube 34 from the ink circulation tube 32 via the connection portion C5 are in pressurized states in the respective ink flow channels. Accordingly, in the case where the ink pressure then becomes lower on the downstream side of the check valve 27 than on the upstream side of the check valve 27 due to the ink depressurization occurring in the curved portion 32R, the ink flows into the circulating flow channel JF from the upstream side of the check valve 27 via the check valve 27.

In this case, in this variation, pressurized ink that has flowed in from the ink return sub tube 34 flows into the upstream side of the check valve 27 via the check valve 28 from the upstream side of the check valve 28, or in other words, from the connection portion C6, in addition to the pressurized ink that has flowed in from the ink return tube 33 via the connection portion C4. As a result, the amount of ink that flows toward the connection portion C6 from the ink cartridge 15 via the check valve 23, or in other words, the amount of ink that flows toward the return flow channel KF, is suppressed to a low amount.

According to this variation, the following effect can be achieved in addition to the effects 1. and 2. of the aforementioned embodiment.

3. Because the ink return sub tube 34 is further provided, even if the ink that flows into the circulating flow channel JF from upstream via the check valve 27 increases, the ink that flows thereinto can be ink that is returned from the circulating flow channel JF to the upstream side of the check valve 27 by the ink return sub tube 34 in addition to the ink return tube 33. Accordingly, a rise in the amount of ink within the circulating flow channel JF can be suppressed.

Note that in this variation, the ink return sub tube 34 may instead be an ink return sub tube 34A in which one end thereof is connected by a connection portion C7 to the flow channel area of the ink supply tube 31 between the connection portions C1 and C2 in the circulating flow channel JF, as indicated by the double-dot-dash line in FIG. 6, rather than to the ink circulation tube 32.

Although the aforementioned embodiment describes one end of the ink return tube 33 as being connected to the ink circulation tube 32 on the exit side of the tube pump 40 by the connection portion C3, the invention is of course not limited thereto. The one end of the ink return tube 33 may instead be connected to the ink circulation tube 32 on the entry side of the tube pump 40, or in other words, on the side of the connection portion C1. Alternatively, the ink return tube 33 may instead be an ink return tube 33A in which one end thereof is connected by the connection portion C7 to the flow channel area of the ink supply tube 31 between the connection portions C1 and C2 in the circulating flow channel JF, as indicated by the broken line in FIG. 6.

Furthermore, in the case where the third liquid flow channel is the ink return tube 33A, the fourth liquid flow channel may be the ink return sub tube 34 in the aforementioned variation.

In the aforementioned embodiment, a liquid reservoir portion 50 that temporarily holds ink in a pressurized state may be provided in a flow channel area in at least one of the ink supply tube 31 and the ink circulation tube 32 between the check valve 23 and the pressure control valve 24. This variation will be described with reference to FIG. 7.

Figure 7:
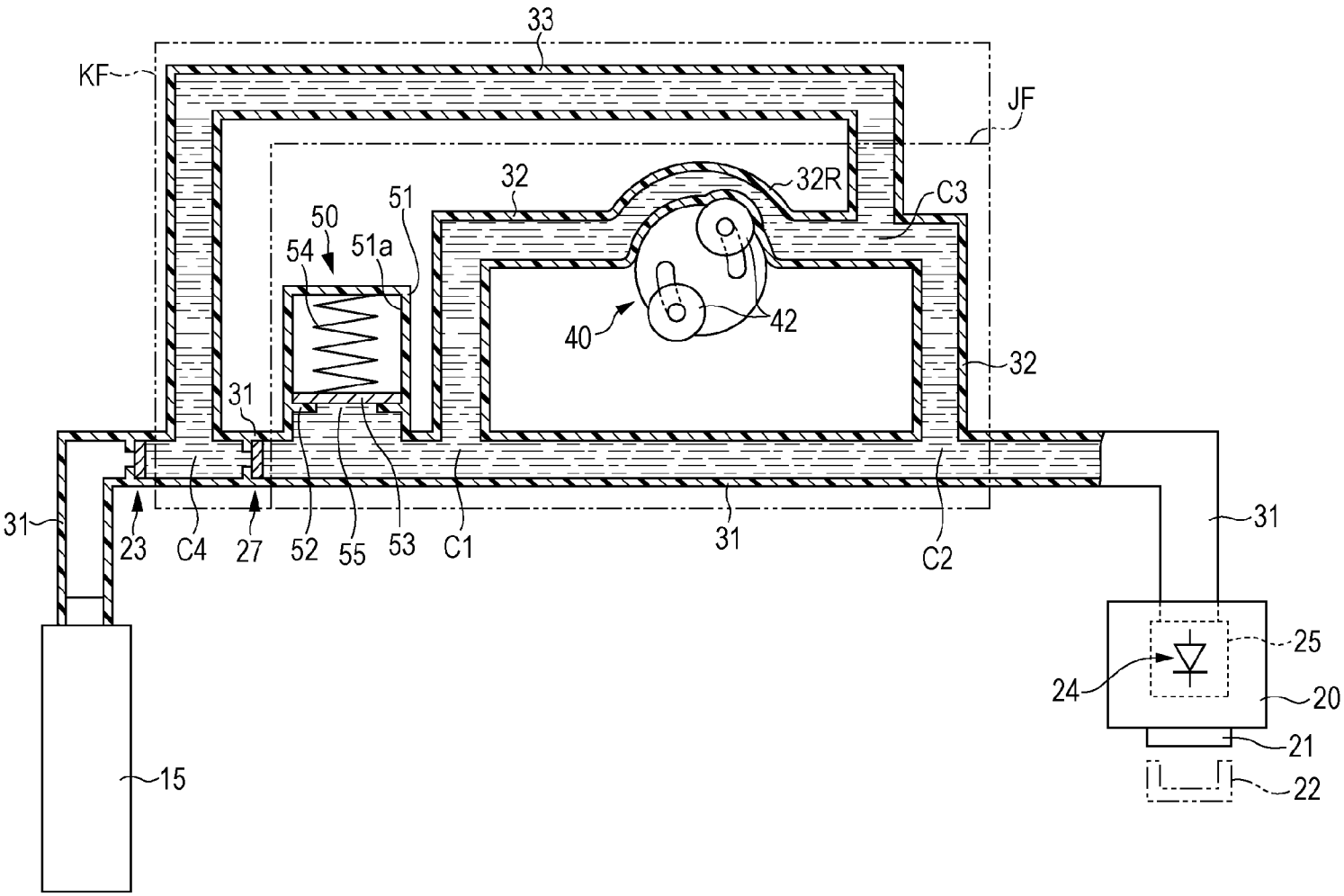
FIG. 7 is a schematic diagram illustrating an example of a liquid flow channel in which a liquid reservoir portion is provided in an ink flow channel area.

As shown in FIG. 7, in this variation, the liquid reservoir portion 50 that holds ink in a pressurized state is provided in a flow channel area of the ink supply tube 31 that is between the check valve 27 and the connection portion C1. The liquid reservoir portion 50 includes a receptacle body 51 formed having a communication portion 55 in which an ink flow channel communicates with the ink supply tube 31, and a displacement plate 53 that displaces so as to change the volume within the receptacle body 51. In this variation, the displacement plate 53 is formed as a flat plate member, and by moving away from the communication portion 55 that joins the ink circulation tube 32 while the peripheral edges of the displacement plate 53 make contact with an inside wall 51*a* of the receptacle body 51, the displacement plate 53 increases the internal volume of the receptacle body 51, increasing the amount of ink that can be held in the liquid reservoir portion 50 as a result.

Meanwhile, the displacement plate 53 is biased so as to move in a direction that reduces the internal volume by a pressurizing portion 54 that is configured of, for example, a coil spring. Accordingly, the amount of liquid that can be temporarily held in the liquid reservoir portion 50 is increased while remaining in a state in which the liquid is pressurized by the pressurizing portion 54, as a result of the displacement plate 53 moving against the biasing force of the pressurizing portion 54. Note that in this variation, a protruding portion 52 that protrudes in a platform shape toward the center when viewed from above is formed in the inside wall 51*a* of the receptacle body 51 so as to engage with the displacement plate 53, and a state in which the displacement plate 53 is limited by the protruding portion 52 from moving in the biasing direction of the pressurizing portion 54 corresponds to a state in which the amount of liquid held in the liquid reservoir portion 50 is zero.

Note that during this displacement, the displacement plate 53 is pressurized by the pressurizing portion 54 in the opposite direction as the direction that increases the internal volume, and thus displaces in a state in which the ink is pressurized. To rephrase, the pressurizing force of the pressurizing portion 54 in the liquid reservoir portion 50 is lower than the pressurizing force produced by the tube pump 40. Accordingly, although detailed descriptions will be omitted here, pressure fluctuations (pulsations) in the ink within the circulating flow channel JF produced as the tube pump 40 operates during ink agitation operations are suppressed by the ink flowing into the liquid reservoir portion 50, the ink flowing out from the liquid reservoir portion 50, and so on. In other words, pressure fluctuations in the ink are suppressed by causing the ink that flows through the ink supply tube 31 to flow into and flow out from the liquid reservoir portion 50 as a result of the displacement plate 53 displacing.

According to this variation, the following effect can be achieved in addition to the effects 1. and 2. of the aforementioned embodiment.

4. The liquid reservoir portion 50 that temporarily holds the ink in a pressurized state is provided, and thus even if the ink that flows into the circulating flow channel JF from the ink cartridge 15 via the check valve 23 increases, the increased amount of ink is temporarily held in the liquid reservoir portion 50, and thus pressure fluctuations in the ink that pulsates within the circulating flow channel JF can be suppressed.

In the aforementioned variation, the liquid reservoir portion 50 may be formed as a diaphragm in which the circumference of the displacement plate 53 is sealed and fixed. In this case, the pressurizing portion 54 may be realized by the diaphragm being directly pressurized using air as a medium, or the diaphragm may be pressurized via a pressure plate.

In the aforementioned embodiment, the tube pump 40 may cause the ink to flow within the circulating flow channel JF in the same direction as the direction in which the ink flows through the ink supply tube 31 when the ink is supplied to the liquid ejecting head 21.

Figure 8:
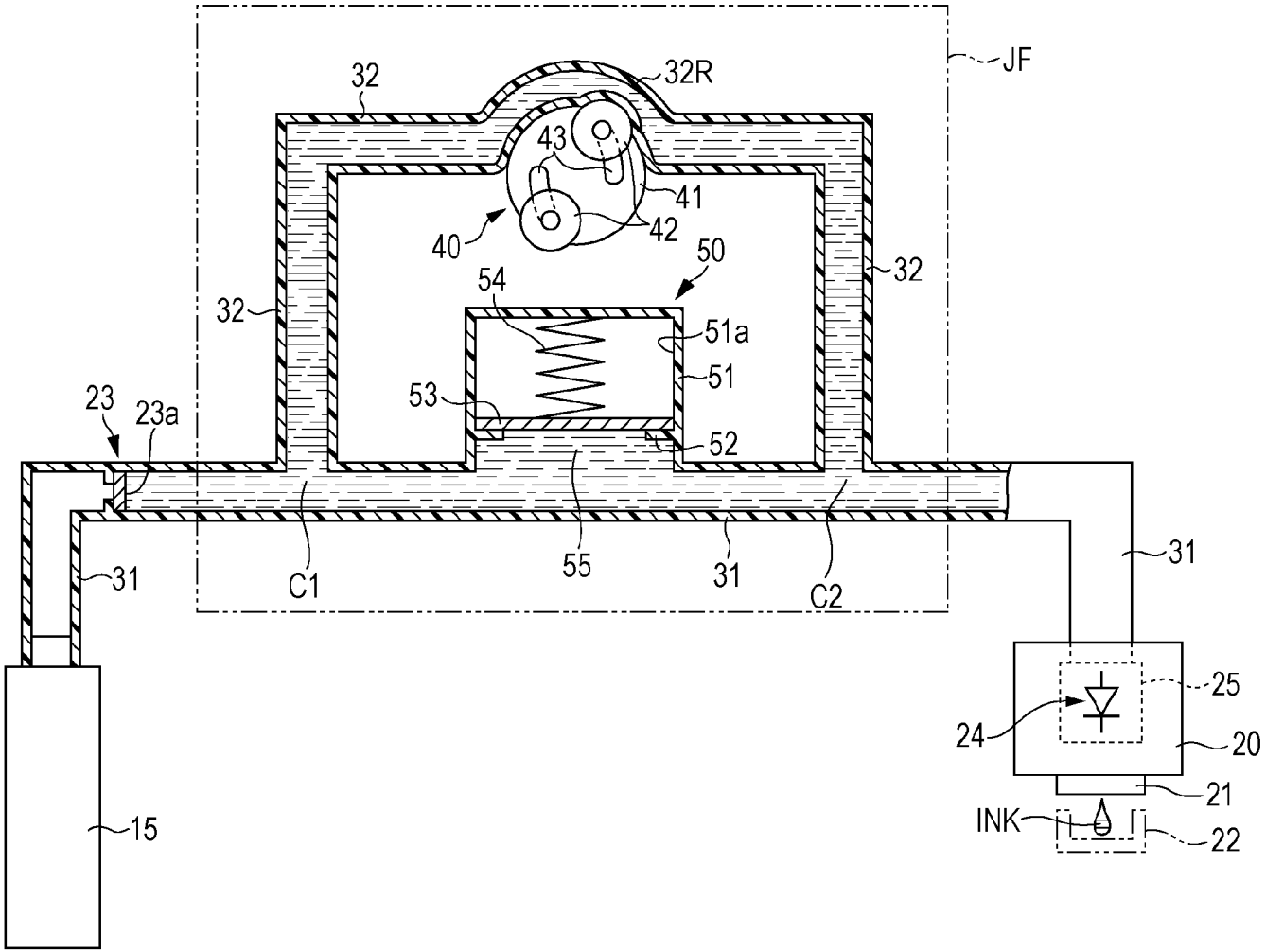
FIG. 8 is a schematic diagram illustrating the configuration of a circulating flow channel provided with a liquid reservoir portion, in a printer according to an embodiment.

Next, another embodiment of the invention will be described with reference to FIG. 8. Note that the respective circulating flow channels JF all have the same configuration in the other embodiment of the invention. Accordingly, FIG. 8 schematically illustrates a single circulating flow channel JF, including other constituent elements, in order to simplify the descriptions. Meanwhile, although the respective constituent elements that configure the circulating flow channel JF are illustrated in FIG. 8 as being a continuous member, in reality, the flow channel is formed of a plurality of members that are connected to each other.

As shown in FIG. 8, the ink circulation tube 32, serving as the second liquid flow channel, that is connected at both ends to the ink supply tube 31 by the connection portions C1 and C2, is provided, and the circulating flow channel JF is formed so that ink circulates between the ink circulation tube 32 and the ink supply tube 31. The tube pump 40 that performs pump operations for causing the ink to flow in the circulating flow channel JF is provided in the ink circulation tube 32 as a circulating pump. Meanwhile, the liquid reservoir portion 50, which functions as a buffer for temporarily holding an increased amount of ink in a pressurized state in the case where the amount of ink within the circulating flow channel JF has increased, is provided in a flow channel area of the ink supply tube 31, between the connection portions C1 and C2 where the ink circulation tube 32 is connected. Note that in the other embodiment of the invention, of the connection portions C1 and C2, the connection portion C1 is the connection portion that is closer to the check valve 23.

In the tube pump 40, an elastic tube (here, part of the ink circulation tube 32) corresponds to the curved portion 32R that is formed in an arc shape; the rollers 42 provided in a mobile state on the rotating member 41 push out the ink in the rotational direction as a result of the rotating member 41 being rotated in one direction by a driving source, causing the ink to flow in the one direction within the circulating flow channel JF as a result. In other words, when the rollers 42 advance into the curved portion 32R, the rollers 42 squeeze the ink circulation tube 32 by moving along the guide hole 43 and away from the rotational center of the rotating member 41. The ink within the ink circulation tube 32 enters a pressurized state as a result of the squeezing. Then, as a result of the rollers 42 rotating (revolving) along the curved portion 32R with the rotating member 41 while squeezing the ink circulation tube 32, the ink within the ink circulation tube 32 is pushed in the rotational direction of the rollers 42 while being pressurized, and is caused to flow in the one direction within the circulating flow channel JF.

After this, when the rollers 42 rotate (revolve) and move away from the curved portion 32R of the ink circulation tube 32, the squeezed state of the ink circulation tube 32 is stopped and the rollers 42 are moved toward the rotational center along the guide hole 43 by a resistive force acting against the squeezing of the rollers 42. As a result, the ink circulation tube 32 returns suddenly to its original shape from the squeezed shape, and the ink within the ink circulation tube 32 enters a depressurized state as a result of the tube returning to its original shape. In this manner, the tube pump 40 is a circulating pump that, while operating, produces pressure fluctuations (pulsations), between a pressurized state and a depressurized state, in the ink within the ink circulation tube 32.

The liquid reservoir portion 50 includes the receptacle body 51 formed having the communication portion 55 in which an ink flow channel communicates with the ink supply tube 31, and the displacement plate 53 that displaces so as to change the volume within the receptacle body 51. In the other embodiment of the invention, the displacement plate 53 is formed as a flat plate member, and by moving away from the communication portion 55 that joins the ink circulation tube 32 while the peripheral edges of the displacement plate 53 make contact with the inside wall 51*a* of the receptacle body 51, the displacement plate 53 increases the internal volume of the receptacle body 51, increasing the amount of ink that can be held in the liquid reservoir portion 50 as a result.

Meanwhile, the displacement plate 53 is biased so as to move in a direction that reduces the internal volume by the pressurizing portion 54 that is configured of, for example, a coil spring. Accordingly, the amount of liquid that can be temporarily held in the liquid reservoir portion 50 is increased while remaining in a state in which the liquid is pressurized by the pressurizing portion 54, as a result of the displacement plate 53 moving against the biasing force of the pressurizing portion 54. Note that in the other embodiment of the invention, the protruding portion 52 that protrudes in a platform shape toward the center when viewed from above is formed in the inside wall 51*a* of the receptacle body 51 so as to engage with the displacement plate 53, and a state in which the displacement plate 53 is limited by the protruding portion 52 from moving in the biasing direction of the pressurizing portion 54 corresponds to a state in which the amount of liquid held in the liquid reservoir portion 50 is zero.

In the other embodiment of the invention, by providing the liquid reservoir portion 50 in the circulating flow channel JF, a rise in the pressure of the ink within the circulating flow channel JF produced by the ink agitation operations can be suppressed. Hereinafter, ink agitation operations performed by the printer 11 according to the other embodiment of the invention, in which the circulating flow channel JF having the liquid reservoir portion 50 is provided in the ink supply tube 31, will be described with reference to FIGS. 9A and 9B. Note that in the other embodiment of the invention, prior to starting the ink agitation operations, the amount of ink held in the liquid reservoir portion 50 is reduced to zero or almost zero by, for example, using the maintenance unit 22 to forcefully eject ink from the liquid ejecting head 21 (the ejecting nozzles) and cause a predetermined amount of ink to flow from the ink supply tube 31 to the liquid ejecting head 21.

Figure 9A:
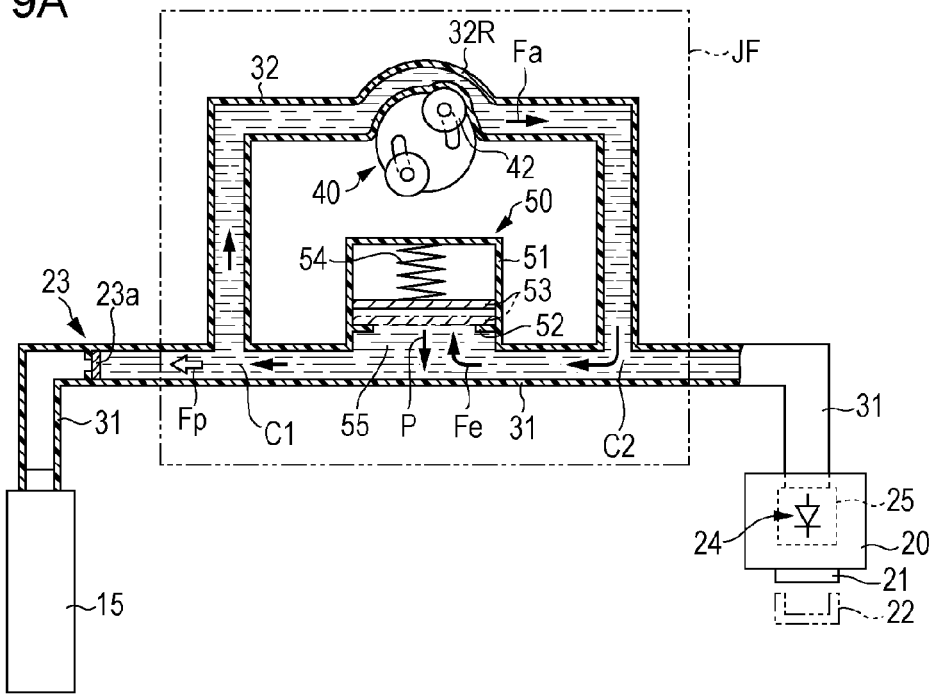
FIGS. 9A and 9B are schematic diagrams illustrating ink circulation operations in the case where a liquid reservoir portion is provided in a circulating flow channel, where

As shown in FIG. 9A, during pump operations, in which the rollers 42 in the tube pump 40 rotate while squeezing the curved portion 32R of the ink circulation tube 32, the ink that is pressurized and pushed out from the curved portion 32R undergoes a circulatory flow, flowing through the circulating flow channel JF in one direction, as indicated by the solid line arrow Fa in FIG. 9A. At this time, in the case where the liquid reservoir portion 50 is provided in a flow channel area of the ink supply tube 31, the ink that flows through the ink supply tube 31 due to the tube pump 40 operating partially flows into and is held in the liquid reservoir portion 50 from the communication portion 55, as indicated by the solid line arrow Fe in FIG. 9A. As a result, the displacement plate 53 displaces from a position prior to the start of the ink agitation operations (a position indicated by a double-dot-dash line in FIG. 9A) to a position distanced from the ink supply tube 31 (a position indicated by a solid line in FIG. 9A).

Note that during this displacement, the displacement plate 53 is pressurized by the pressurizing portion 54 in the opposite direction as a direction indicated by the arrow P in FIG. 9A, and thus displaces in a state in which the ink is pressurized. To rephrase, the pressurizing force of the pressurizing portion 54 in the liquid reservoir portion 50 is lower than the pressurizing force produced by the tube pump 40. Note that during this operating state of the pump, the pressure downstream from the check valve 23 rises as indicated by the white arrow Fp in FIG. 9A, the on/off valve 23*a* closes, and the ink does not flow toward the circulating flow channel JF from the ink cartridge 15, in the same manner as in the comparative example shown in FIGS. 3A and 3B. In addition, the pressure control valve 24 prevents the ink from flowing toward the liquid ejecting head 21 from the ink supply tube 31.

Figure 9B:
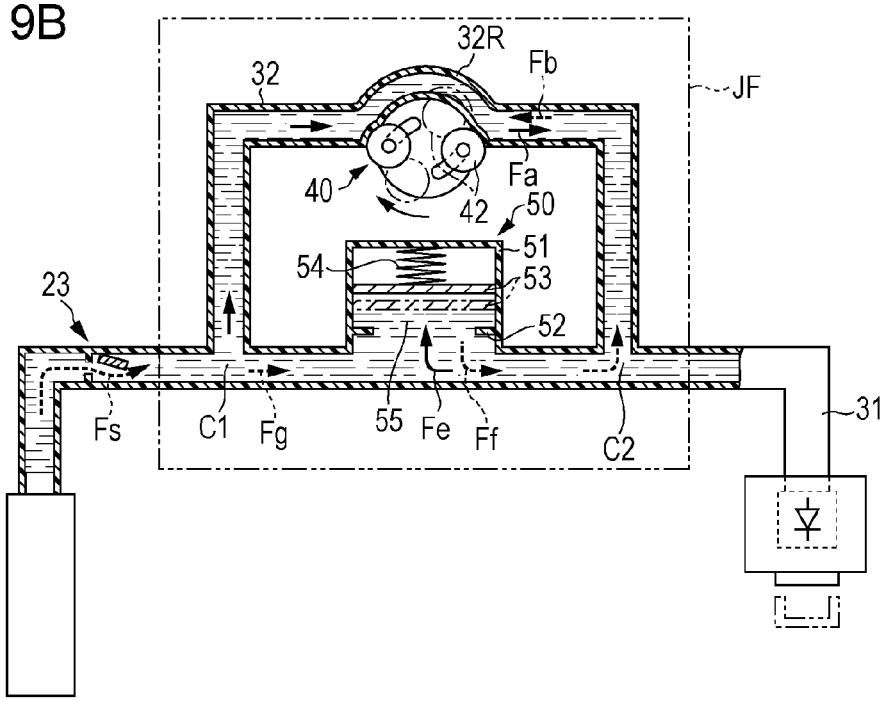

Next, as shown in FIG. 9B, when the rollers 42 in the tube pump 40 rotate further and move away from the curved portion 32R in the ink circulation tube 32, the ink circulation tube 32 that was being squeezed by the rollers 42 returns to its original shape, and as a result, the ink is depressurized. Accordingly, in the circulating flow channel JF, the ink flows in the direction from the connection portion C2 toward the curved portion 32R, as indicated by the broken line arrow Fb in FIG. 9B. Note that when the ink flows from the connection portion C1 toward the curved portion 32R along the ink circulation tube 32, the flow is maintained in essentially the same direction although changes occur in the flow velocity.

As a result, in the same manner as in the comparative example shown in FIGS. 3A and 3B, the ink flows from the connection portion C1 toward the connection portion C2 in the ink supply tube 31 as well; because this ink flow attempts to pull the ink located downstream from the check valve 23, the pressure downstream from the check valve 23 drops (that is, the ink is depressurized). However, at this time, in the other embodiment of the invention, the ink held in a pressurized state in the liquid reservoir portion 50 flows out from the liquid reservoir portion 50 to the ink supply tube 31 due to the pressurizing force of the pressurizing portion 54, unlike in the comparative example.

This ink that has flowed out from the liquid reservoir portion 50 primarily flows toward the connection portion C2 and toward the curved portion 32R that produces the depressurization, as indicated by the broken line arrow Ff in FIG. 9B, but some of the ink also flows toward the connection portion C1, which is located closer to the check valve 23. As a result, the amount of ink that flows from the connection portion C1 toward the connection portion C2 in the ink supply tube 31 is suppressed. Accordingly, depressurization of the ink occurring at the connection portion C1 can be immediately suppressed by the pressurized ink in the liquid reservoir portion 50.

By suppressing the depressurization of the ink at the connection portion C1 in this manner, the amount of ink that flows through the ink supply tube 31 from the connection portion C1 toward the connection portion C2 is suppressed to a lower amount than in the comparative example, as indicated by the broken line arrow Fg in FIG. 9B. As a result, the amount of ink that flows into the circulating flow channel JF from the downstream side of the check valve 23 is also suppressed to an amount that is based on the amount of ink that flows through the ink supply tube 31 from the connection portion C1 toward the connection portion C2, as indicated by the broken line arrow Fs in FIG. 9B.

Note that the flow channel on the side of the liquid ejecting head 21 is closed by the pressure control valve 24, and thus ink does not flow (backflow) from the liquid ejecting head 21. As a result, ink flows downstream from the ink cartridge 15 via the check valve 23 and accumulates in the ink flow channel between the check valve 23 and the pressure control valve 24, or in other words, in the ink supply tube 31 and the circulating flow channel JF, in the same manner as in the comparative example illustrated in FIGS. 3A and 3B.

Next, when the rollers 42 rotate further and the pump once again enters an operating state in which the rollers 42 rotate while squeezing the curved portion 32R of the ink circulation tube 32 as indicated in FIG. 9A, the ink is pushed out from the curved portion 32R, and the circulatory flow in which the ink flows in one direction through the circulating flow channel JF occurs once again. At this time, the amount of ink in the ink flow channel increases by a predetermined amount due to the ink that has flowed in from the ink cartridge 15. Accordingly, the ink that flows through the ink supply tube 31 as a result of the tube pump 40 operating flows into the liquid reservoir portion 50, and the displacement plate 53 displaces so as to increase the internal volume in accordance with the increase in the amount of ink. As a result, as shown in FIG. 9B, the displacement plate 53 displaces significantly from a position at the point in time when the ink agitation operations are started (a position indicated by a double-dot-dash line in FIG. 9B) to a position that is significantly distanced from the ink supply tube 31 (a position indicated by a solid line in FIG. 9B).

Accordingly, by continuing to perform the ink agitation operations, ink will flow downstream via the check valve 23 from the ink cartridge 15 with each pressure fluctuation caused by the tube pump 40 operating, and the amount of ink that accumulates in the ink flow channel between the check valve 23 and the pressure control valve 24 will gradually increase. In the other embodiment of the invention, the ink that has flowed from the ink cartridge 15 and increased is temporarily held in a pressurized state in the liquid reservoir portion 50, whose internal volume increases as a result of the displacement plate 53 gradually displacing more as the amount of ink increases.

Note that in the other embodiment of the invention, during a single ink agitation operation, the amount of ink that flows from the ink cartridge 15 and accumulates and increases in the ink flow channel between the check valve 23 and the pressure control valve 24 is assumed to be a smaller amount than the maximum internal volume that can be obtained in the liquid reservoir portion 50 by the displacement plate 53 displacing. In addition, in the period from when an ink agitation operation has ended until the next ink agitation operation is carried out, ink is forcefully ejected from the liquid ejecting head 21 (the ejecting nozzles) by the maintenance unit 22 and a predetermined amount of ink is caused to flow out from the ink supply tube 31 toward the liquid ejecting head 21. As a result of this flow, the ink temporarily held in the liquid reservoir portion 50 is discharged, and the amount of ink held in the liquid reservoir portion 50 is reduced to zero or almost zero.

According to the other embodiment of the invention described thus far, the following effects can be achieved.

5. Even if the amount of ink in the circulating flow channel JF increases due to the ink flowing into the circulating flow channel JF from the ink cartridge 15 via the check valve as a result of the depressurization occurring when the tube pump 40 operates, the amount of ink that has increased is temporarily held in the liquid reservoir portion 50 in a pressurized state. As a result, the pressure within the circulating flow channel JF is held constant by pressurization realized by the liquid reservoir portion 50. Accordingly, the depressurization occurring when the tube pump 40 operates can be counteracted by the ink held in the liquid reservoir portion 50 in a pressurized state, and an increase in the pressure of the ink within the circulating flow channel JF can be suppressed by suppressing the amount of ink that flows into the circulating flow channel JF from the ink cartridge 15 side.

6. Because the liquid reservoir portion 50 is provided in a flow channel area configured by the ink supply tube 31 in the circulating flow channel JF, the tube pump 40 and the liquid reservoir portion 50 are located on either side of the connection portion C1 between the first liquid flow channel and the second liquid flow channel. Accordingly, depressurization of the ink occurring at the connection portion C1 due to the tube pump 40 operating can be immediately suppressed by the pressurized ink in the liquid reservoir portion. As a result, depressurization of the ink in the ink supply tube 31 in the area from the connection portion C1, which is located closer to the check valve 23, to the check valve 23 is suppressed, which makes it possible to suppress the ink from flowing into the circulating flow channel JF from the ink cartridge 15 side.

7. The ink that flows through the circulating flow channel JF flows in the opposite direction as the direction in which the ink flows through the ink flow channel in the ink supply tube 31 during normal use of the printer 11, and thus the ink can be effectively agitated in the ink supply tube 31.

8. Because the liquid reservoir portion 50 holds the ink that flows into the circulating flow channel JF after being in an empty state, in which no ink is held, the amount of ink that increases in the circulating flow channel JF can be held with certainty. Accordingly, a rise in the pressure of the ink within the circulating flow channel JF can be suppressed with a high rate of success.

Note that the aforementioned other embodiment of the invention may be changed to the other embodiments described hereinafter as well.

In the aforementioned other embodiment of the invention, the liquid reservoir portion 50 is not limited to being provided in the flow channel area configured by the ink supply tube 31 in the circulating flow channel JF, and may instead be provided in another flow channel area as long as that area is within the circulating flow channel JF. This variation will be described with reference to FIGS. 10A and 10B.

Figure 10A:
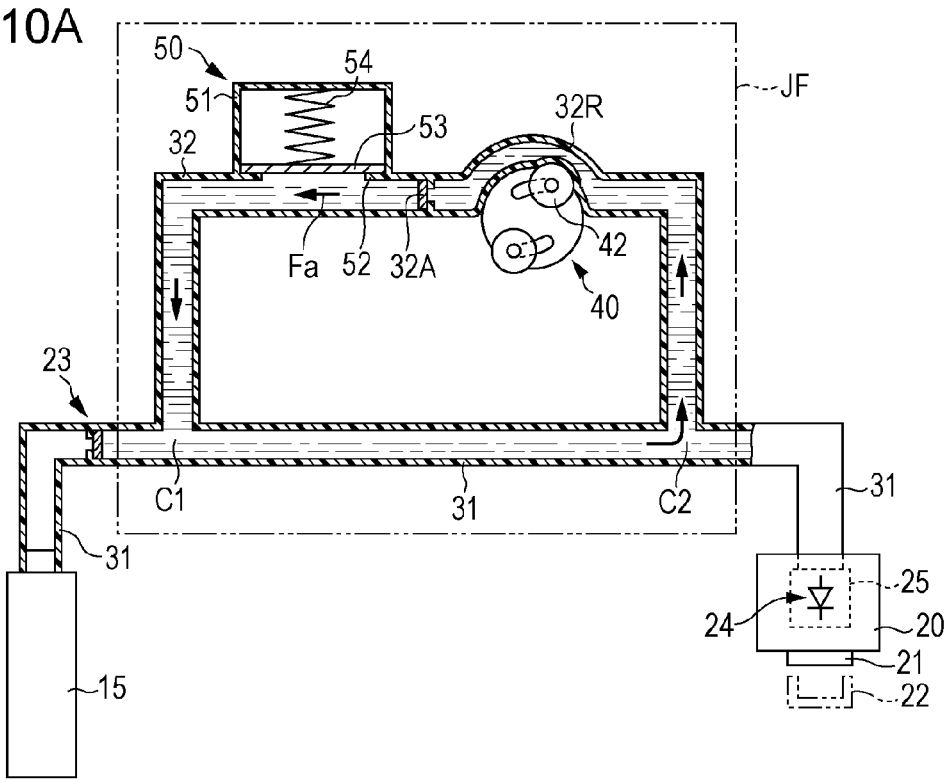
FIGS. 10A and 10B are schematic diagrams illustrating a circulating flow channel in which a liquid reservoir portion is provided in a different location than in a previous embodiment.

As shown in FIG. 10A, the liquid reservoir portion 50 may be provided in a flow channel area of the ink circulation tube 32 in the circulating flow channel JF. For example, in this variation, the tube pump 40 may agitate the ink within the circulating flow channel JF in the same direction as the direction in which the ink flows through the ink supply tube 31 when the ink is supplied to the liquid ejecting head 21 (that is, the direction indicated by the solid line arrow Fa in FIG. 10A). The liquid reservoir portion 50 may be provided in a flow channel area that is between the tube pump 40 and the check valve 23 in a location that is downstream in the direction in which the ink flows after being pushed out from the curved portion 32R of the ink circulation tube 32 during the ink agitation operations. By doing so, the pressurized ink is caused to flow into the liquid reservoir portion 50 with little loss of flow momentum in the circulating flow channel JF, and thus it can be expected that the ink pressure will be quickly absorbed by the liquid reservoir portion 50.

According to this variation, the following effects can be achieved in addition to the effects 5. and 8. of the aforementioned other embodiment of the invention.

9. When the tube pump 40 operates, it is easier for the connection portion C1, which is downstream in the direction of the flow of ink produced by the tube pump 40, to enter a depressurized state, than it is for the upstream area to enter a depressurized state, due to the pulsations of the ink produced by the operation of the tube pump 40. Accordingly, depressurization of the ink occurring at the connection portion C1 that is downstream from the tube pump 40 due to the tube pump 40 operating can be immediately suppressed by the pressurized ink in the liquid reservoir portion 50. Accordingly, the depressurization acting on the check valve 23 can be efficiently suppressed by suppressing the state of depressurization occurring at the connection portion C1 that is downstream in the direction in which the ink flows when the tube pump 40 operates, which in turn makes it possible to suppress the ink from flowing into the circulating flow channel JF from the ink cartridge 15 side.

Note that even in the case where the tube pump 40 causes the ink to flow through the circulating flow channel JF in the opposite direction as the direction in which the ink flows through the ink supply tube 31 when the ink is supplied to the liquid ejecting head 21, the same effects can be expected to be achieved by providing the liquid reservoir portion 50 in a flow channel area located downstream in the direction in which the ink flows in the circulating flow channel JF during ink agitation operations.

In addition, as shown in FIG. 10A, a check valve 32A that by closing stops the flow of ink in the opposite direction as the direction in which the ink flows in the circulating flow channel JF during ink agitation operations may be provided in a flow channel area of the ink circulation tube 32 between the connection portion C1, which is located downstream from the tube pump 40 in the direction in which the ink flows in the circulating flow channel JF during ink agitation operations, and the tube pump 40. By doing so, in addition to the effects achieved by providing the liquid reservoir portion 50, the check valve 32A can prevent a flow of ink in the opposite direction as the direction of the flow of ink in the circulating flow channel JF during the ink agitation operations produced when the rollers 42 of the tube pump 40 move away from the curved portion 32R of the ink circulation tube 32 and the tube that was being squeezed returns to its original shape. Through this, a negative pressure can be suppressed from acting on the check valve 23.

Furthermore, the check valve 32A is provided in a flow channel area of the ink circulation tube 32 between the tube pump 40 and the liquid reservoir portion 50 in this variation, and thus the same effects as in the case where the check valve 32A is provided in a flow channel area of the ink circulation tube 32 between the liquid reservoir portion 50 and the connection portion C1 can be expected to be achieved. Note that in the case where the direction of the flow of ink in the circulating flow channel JF during the ink agitation operations is the opposite direction as in this variation, the check valve 32A is provided in a flow channel area of the ink circulation tube 32 that is between the connection portion C2 and the tube pump 40.

Figure 10B:
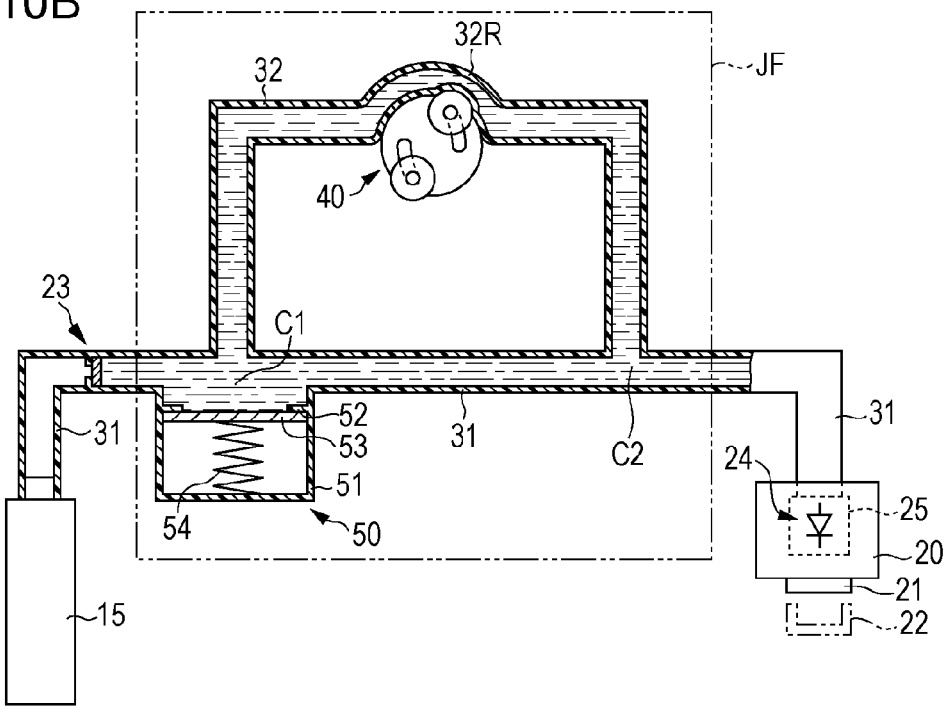

Alternatively, as shown in FIG. 10B, the liquid reservoir portion 50 may be provided in the circulating flow channel JF at the connection portion C1 that connects the ink circulation tube 32 and the ink supply tube 31. For example, the liquid reservoir portion 50 may be provided at the connection portion C1 that, of the two connection portions C1 and C2, is closer to the check valve 23, as in this variation. By doing so, in the case where the ink downstream from the check valve 23 is pulled toward the curved portion 32R, it can be expected that the flow of ink that is pulled from the check valve 23 side by the ink flowing out from the liquid reservoir portion 50 will be suppressed. Accordingly, the amount of ink that flows in from the ink cartridge 15 via the check valve 23 can be suppressed.

In the aforementioned other embodiment of the invention, a plurality of liquid reservoir portions 50 may be provided in the circulating flow channel JF. In addition, in this case, the plurality of liquid reservoir portions 50 may be provided in each of the flow channel areas that configure the ink supply tube 31 in the circulating flow channel JF and that are connected in parallel between the pressure control valve 24 and the check valve 23. This variation will be described with reference to FIG. 11.

Figure 11:
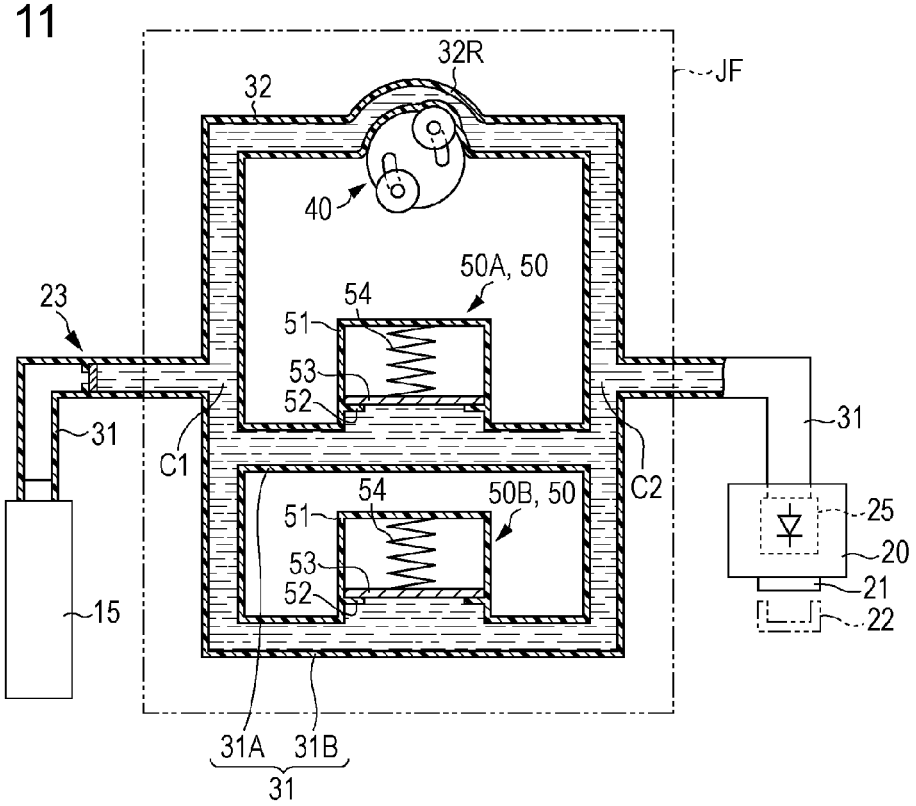
FIG. 11 is a schematic diagram illustrating an example of a circulating flow channel in which a plurality of liquid reservoir portions are provided.

As shown in FIG. 11, the liquid reservoir portions 50 divide the ink supply tube 31 in the circulating flow channel JF into two branching supply tubes 31A and 31B so that two parallel ink flow channels are formed. The liquid reservoir portions 50 (50A and 50B) are provided in flow channel areas of the respective divided branching supply tubes 31A and 31B. Accordingly, the ink that is pushed out from the curved portion 32R of the ink circulation tube 32 during the ink agitation operations flows through the two branching supply tubes 31A and 31B and flows into the respective liquid reservoir portions 50 at essentially the same time, and thus even if the ink increases suddenly in the circulating flow channel JF, it can be expected that the ink will be held in the liquid reservoir portions 50 with certainty.

In addition, by providing a plurality of liquid reservoir portions in parallel in this manner, the amount of ink that can be held can be increased without increasing the area of the printer 11 occupied by the respective liquid reservoir portions 50. It is also possible to vary the pressurizing force of the pressurizing portions 54 in the liquid reservoir portions 50 as necessary, such as in the case where the pressurizing force on the ink held in the respective liquid reservoir portions 50 is to be adjusted.

Note that although not shown in the drawings here, in the case where a plurality of liquid reservoir portions 50 are provided in the circulating flow channel JF, the liquid reservoir portions 50 may be provided in flow channel areas of both the ink circulation tube 32 and the ink supply tube 31. Furthermore, in the case where the plurality of liquid reservoir portions 50 are provided in flow channel areas of the ink supply tube 31 or the ink circulation tube 32, the liquid reservoir portions are not limited to parallel connections as shown in FIG. 11, and may instead be provided in a serial connection along the direction in which the ink flows.

According to this variation, the following effects can be achieved in addition to the effects 5. through 8. of the aforementioned other embodiment of the invention.

10. Because a plurality of liquid reservoir portions 50 are provided in the circulating flow channel JF, in the case where there has been a large increase in the amount of ink that flows into the circulating flow channel JF from the ink cartridge 15 side, the increased ink is distributed among and held in the plurality of liquid reservoir portions 50, and thus a rise in the pressure in the circulating flow channel JF can be suppressed.

11. Because the plurality of liquid reservoir portions 50 are provided so that the ink flow channels are connected in parallel, in the case where the amount of ink that flows into the circulating flow channel JF from the ink cartridge 15 side increases suddenly, the increased ink can be distributed among and held simultaneously in the liquid reservoir portions 50 (50A and 50B) that are provided in parallel, and thus a rise in the pressure in the circulating flow channel can be suppressed.

In the aforementioned embodiment, the circulating flow channel JF may be configured so as to include flow channel areas that have different elevations so as to absorb different elevations arising between the liquid ejecting head 21 and the ink cartridge 15. This variation will be described with reference to FIG. 12.

Figure 12:
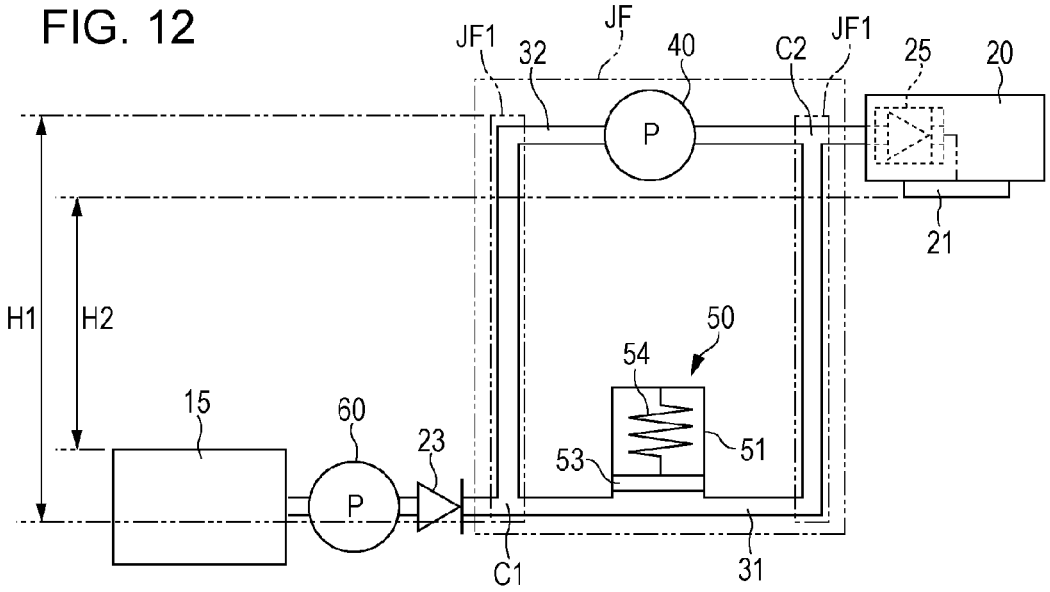
FIG. 12 is a schematic diagram illustrating an example of a circulating flow channel that connects a liquid ejecting head and an ink cartridge that have different elevations.

As shown in FIG. 12, in this variation, the connection portions C1 and C2 between both ends of the ink circulation tube 32 and the ink supply tube 31 in the circulating flow channel JF are at different heights. Specifically, of the connection portions C1 and C2, the height of the connection portion C2, which serves as an example of a second connection portion located in the ink supply tube 31 on the liquid ejecting head 21 side in the flow direction, is set to be higher than the connection portion C1, which serves as an example of a first connection portion located on the ink cartridge 15 side. Accordingly, the circulating flow channel JF is configured so as to include a flow channel area JF1 having an elevation difference H1. Further, a feed pump 60 that is driven when supplying the ink held in the ink cartridge 15 to the liquid ejecting head 21 via the ink supply tube 31 is provided in a location of the ink supply tube 31 that is closer to the ink cartridge 15 than the connection portion C1 in the flow channel direction.

Note that an elevation difference H2 between the liquid ejecting head 21 and the ink cartridge 15 is approximately the same as the elevation difference H1 of the flow channel area JF1 in the circulating flow channel JF. Accordingly, the elevation difference H1 between the liquid ejecting head 21 and the ink cartridge 15 is absorbed by the flow channel area JF1 of the circulating flow channel JF. However, the elevation difference in the circulating flow channel JF may be less than the elevation difference H1 between the liquid ejecting head 21 and the ink cartridge 15. In other words, the configuration may be such that the elevation difference H1 between the liquid ejecting head 21 and the ink cartridge 15 is partially absorbed by the circulating flow channel JF.

Incidentally, if an elevation difference is present in the flow channel that supplies the liquid from the ink cartridge 15 to the liquid ejecting head 21, it is easy for pigment particles contained in the ink to sink downward in the flow channel area where the elevation difference is present, and thus a slope is formed in the concentration of pigment particles, with the concentration of pigment particles gradually increasing from top to bottom. Accordingly, there has been a problem in that when ink supplied from this flow channel area is ejected onto the paper S via the liquid ejecting head 21, variations will occur in the concentration of the pigment particles contained in the ejected ink.

With respect to this point, according to this variation, the elevation difference H2 between the liquid ejecting head 21 and the ink cartridge 15 is absorbed by the flow channel area JF1 in the circulating flow channel JF, and thus an elevation difference in the areas of the flow channel, aside from the circulating flow channel JF, that connects the liquid ejecting head 21 to the ink cartridge 15 can be reduced. In other words, by providing an elevation difference in the circulating flow channel JF that can circulate and agitate the ink, the ink is supplied to the liquid ejecting head 21 while suppressing the pigment particles contained in the ink from sinking. Accordingly, variations in the concentration of the pigment particles contained in the ink ejected from the liquid ejecting head 21 onto the paper S are suppressed from occurring.

Meanwhile, in this variation, when the carriage 20 moves the liquid ejecting head 21, an area of the circulating flow channel JF that is in the vicinity of the liquid ejecting head 21 moves along with the carriage 20. Accordingly, the ink within the circulating flow channel JF is agitated not only by the ink circulating within the circulating flow channel JF, but is also agitated by the area of the circulating flow channel JF in the vicinity of the liquid ejecting head 21 moving along with the carriage 20. For this reason, the ink is supplied to the liquid ejecting head 21 while further suppressing the pigment particles contained in the ink from sinking. Accordingly, variations in the concentration of the pigment particles contained in the ejected from the liquid ejecting head 21 onto the paper S are further suppressed from occurring.

According to this variation, the following effects can be achieved in addition to the effects 1. through 11. of the aforementioned embodiments of the invention.

12. The circulating flow channel JF, which is formed by connecting both ends of the ink circulation tube 32 to the ink supply tube 31, includes the flow channel area JF1 having the elevation difference H1. The flow channel area JF1 absorbs the elevation difference H2 that is present between the position of the liquid ejecting head 21 and the position of the ink cartridge 15. Accordingly, an elevation difference occurring in areas of the flow channel that connects the ink cartridge 15 and the liquid ejecting head 21 aside from the circulating flow channel JF can be suppressed. In other words, by providing an elevation difference in the circulating flow channel JF that can circulate and agitate the ink, the ink is supplied to the liquid ejecting head 21 while suppressing the pigment particles contained in the ink from sinking. Accordingly, variations in the concentration of the pigment particles contained in the ink ejected from the liquid ejecting head 21 onto the paper S can be suppressed from occurring.

13. When the carriage 20 moves the liquid ejecting head 21, an area of the circulating flow channel JF that is in the vicinity of the liquid ejecting head 21 moves along with the carriage 20. Accordingly, the ink within the circulating flow channel JF is agitated not only by the ink circulating within the circulating flow channel JF, but is also agitated by the area of the circulating flow channel JF in the vicinity of the liquid ejecting head 21 moving along with the carriage 20. For this reason, the ink is supplied to the liquid ejecting head 21 while further suppressing the pigment particles contained in the ink from sinking. Accordingly, variations in the concentration of the pigment particles contained in the ink ejected from the liquid ejecting head 21 onto the paper S can be further suppressed from occurring.

In the aforementioned other embodiment of the invention, agitation operations resulting from the tube pump 40 being rotated do not necessarily need to be started in a state in which no ink is held in the liquid reservoir portion 50. For example, it is not necessary to set the amount of ink held in the liquid reservoir portion 50 to zero in the case where there is sufficient space for ink to be held therein.

In the aforementioned other embodiment of the invention, the liquid reservoir portion 50 may be formed as a diaphragm in which the circumference of the displacement plate 53 is sealed and fixed. In this case, rather than a coil spring, the pressurizing portion 54 may have a configuration in which the diaphragm is directly pressurized using air as a medium, or a configuration in which the diaphragm is pressurized via a pressure plate.

Note that in all of the aforementioned embodiments, the circulating pump is not necessarily limited to a tube pump 40. For example, the circulating pump may be a diaphragm pump that uses a diaphragm and two check valves. Even if the diaphragm pump is used, the ink undergoes a pulsating flow when the diaphragm moves back and forth (vibrates), and thus the ink that flows within the diaphragm pump pulsates. This pulsation causes pressure fluctuations in the ink within the circulating flow channel JF, in the same manner as a tube pump.

In addition, in any of the aforementioned embodiments, the number of ink cartridges 15 is not limited to four, and there may be more than four or less than four ink cartridges 15. Furthermore, it is not necessary for the printer 11 to be configured so that the liquid ejecting head 21 moves in the scanning direction, and the configuration may instead be such that the liquid ejecting head 21 ejects ink onto the paper S at a fixed position.

In addition, in the above embodiments, the liquid ejecting apparatus is embodied as the ink jet printer 11, but a liquid ejecting apparatus that ejects or expels another liquid aside from ink may serve as the embodiment instead. The invention can also be applied in various types of liquid ejecting apparatuses including liquid ejecting heads that eject minute liquid droplets. Note that "droplet" refers to the state of the liquid ejected from the liquid ejecting apparatus, and is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid state, including liquids having high or low viscosity, sol, gel water, other inorganic agents, inorganic agents, liquid solutions, liquid resins, and fluid states such as liquid metals (metallic melts); furthermore, in addition to liquids as a single state of a matter, liquids in which the molecules of a functional material composed of a solid matter such as pigments, metal particles, or the like are dissolved, dispersed, or mixed in a liquid carrier are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. Liquid ejecting apparatuses that eject liquids including materials such as electrode materials, coloring materials, and so on in a dispersed or dissolved state for use in the manufacture and so on of, for example, liquid-crystal displays, EL (electroluminescence) displays, front emission displays, and color filters can be given as specific examples of liquid ejecting apparatuses. Alternatively, the liquid ejecting apparatus may be a liquid ejecting apparatus that ejects bioorganic matters used in the manufacture of biochips, a liquid ejecting apparatus that ejects liquids to be used as samples for precision pipettes, printing equipment, a microdispenser, and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatus that eject an etching liquid such as an acid or alkali onto a substrate or the like for etching. The invention can be applied to any type of these liquid ejecting apparatuses.

Next, additional descriptions will be given of technical concepts that can be understood from the aforementioned embodiments.

In the liquid ejecting apparatus according a first aspect of the invention, it is preferable that the position of the liquid ejecting head and the position of the liquid supply source be at different heights; and of the connection portions between both ends of the second liquid flow channel and the first liquid flow channel, the height of the position of the first connection portion that is located in the first liquid flow channel on the liquid supply source side in the flow direction be different from the height of the second connection portion that is located on the liquid ejecting head side.

According to this configuration, the circulating flow channel formed by both ends of the second liquid flow channel being connected to the first liquid flow channel includes a flow channel area having an elevation difference. This flow channel area absorbs an elevation difference that is present between the position of the liquid ejecting head and the position of the liquid supply source. Accordingly, an elevation difference occurring in areas of the flow channel that connects the liquid supply source and the liquid ejecting head aside from the circulating flow channel can be suppressed. In other words, by providing an elevation difference in the circulating flow channel that enables the liquid to be circulated and agitated, it is possible to supply the liquid to the liquid ejecting head while suppressing particles contained in the liquid from sinking.

A liquid ejecting apparatus includes a liquid ejecting head that ejects a liquid; a first liquid flow channel that supplies the liquid from an upstream side corresponding to a liquid supply source side to the liquid ejecting head that is located on a downstream side; a second liquid flow channel that is connected at both ends to the first liquid flow channel and that, with the first liquid flow channel, forms a circulating flow channel that circulates the liquid; and a circulating pump, provided in the circulating flow channel, that by operating causes the liquid to flow within the circulating flow channel, and in the liquid ejecting apparatus, the position of the liquid ejecting head and the position of the liquid supply source are at different heights; and of the connection portions between both ends of the second liquid flow channel and the first liquid flow channel, the height of the position of the first connection portion that is located in the first liquid flow channel on the liquid supply source side in the flow direction is different from the height of the second connection portion that is located on the liquid ejecting head side.

When an elevation difference is provided between the position of the liquid ejecting head and the position of the liquid supply source, an elevation difference is also produced in the flow channel that supplies a liquid from the liquid supply source to the liquid ejecting head. In this case, it is easy for particles contained in the liquid to sink downward at the flow channel area where the elevation difference is produced, and as a result, a slope is formed in the concentration of the particles, with the concentration of the particles gradually increasing from top to bottom. Accordingly, there has been a problem in that when liquid supplied from this flow channel area is ejected onto a medium via the liquid ejecting head, variations will occur in the concentration of the particles contained in the ejected liquid.

With respect to this point, according to this configuration, the circulating flow channel formed by both ends of the second liquid flow channel being connected to the first liquid flow channel includes a flow channel area having an elevation difference. This flow channel area absorbs an elevation difference that is present between the position of the liquid ejecting head and the position of the liquid supply source. Accordingly, an elevation difference occurring in areas of the flow channel that connects the liquid supply source and the liquid ejecting head aside from the circulating flow channel can be suppressed. In other words, by providing an elevation difference in the circulating flow channel that enables the liquid to be circulated and agitated, the liquid is supplied to the liquid ejecting head while suppressing particles contained in the liquid from sinking. Accordingly, variations in the concentration of the particles contained in the liquid ejected from the liquid ejecting head onto the medium can be suppressed from occurring.

What is claimed is:

1. A liquid ejecting apparatus comprising:

a liquid ejecting head that ejects a liquid on a target;

a first liquid flow channel that supplies the liquid from an upstream side corresponding to a liquid supply source side to the liquid ejecting head that is located on a downstream side;

a pressure control valve that is provided in the first liquid flow channel and that opens as a result of a drop in pressure on the liquid ejecting head side;

a first check valve that is provided in the first liquid flow channel closer to the liquid supply source than the pressure control valve and that prevents backflow from the pressure control valve side toward the liquid supply source side;

a second liquid flow channel that has one end connected to a first connection portion on the pressure control valve side and that has another end connected to a second connection portion on the first check valve side between the pressure control valve and the first check valve in the first liquid flow channel, the second liquid flow channel configuring a circulating flow channel for the liquid being circulated in cooperation with the first liquid flow channel;

a circulating pump that is provided in the second liquid flow channel and that causes the liquid to flow in one direction in the circulating flow channel; and a second check valve that is provided in the second liquid flow channel between the second connection portion and the circulating.

2. The liquid ejecting apparatus according to claim 1, wherein the liquid ejecting head is mounted on a carriage that can move above the target, and the circulating flow channel includes a part that moves in response to the movement of the carriage.

3. The liquid ejecting apparatus according to claim 1, wherein the circulating pump is a diaphragm pump that includes a diaphragm.

4. The liquid ejecting apparatus according to claim 1, wherein the first liquid flow channel is connected to the liquid ejecting head and the liquid ejecting head is arranged to have an elevation difference with respect to the liquid supply source, and the first connection portion and the second connection portion have an elevation difference.

5. The liquid ejecting apparatus according to claim 4, wherein the elevation difference between the liquid ejecting head and the liquid supply source is approximately the same as the elevation difference between the first connection portion and the second connection portion.

6. The liquid ejecting apparatus according to claim 1, further comprising a liquid reservoir portion that is provided at the second connection portion and that is capable of holding the liquid in the second liquid flow channel in a pressurized state.

7. The liquid ejecting apparatus according to claim 1, further comprising a liquid reservoir portion that is provided in the second liquid flow channel between the second connection portion and the second check valve and that is capable of holding the liquid in the liquid flow channel in a pressurized state.

* * * * *